US010772369B2

(12) United States Patent
Horton

(10) Patent No.: US 10,772,369 B2
(45) Date of Patent: Sep. 15, 2020

(54) ARTICLE OF CLOTHING HAVING MAGNETIC FASTENING ASSEMBLIES

(71) Applicant: Magna Ready LLC, Cincinnati, OH (US)

(72) Inventor: Maura M. Horton, Raleigh, NC (US)

(73) Assignee: GBG USA Inc., New York, NY (US)

( * ) Notice: Subject to any disclaimer, the term of this patent is extended or adjusted under 35 U.S.C. 154(b) by 290 days.

(21) Appl. No.: 15/888,546

(22) Filed: Feb. 5, 2018

(65) Prior Publication Data

US 2018/0153239 A1 Jun. 7, 2018

Related U.S. Application Data

(63) Continuation of application No. 15/277,554, filed on Sep. 27, 2016, now Pat. No. 10,278,440, which is a continuation of application No. 14/066,787, filed on Oct. 30, 2013, now Pat. No. 9,549,580, which is a continuation-in-part of application No. 13/961,363, filed on Aug. 7, 2013, now abandoned, which is a continuation-in-part of application No. 13/674,542, filed on Nov. 12, 2012, now Pat. No. 9,210,953.

(51) Int. Cl.

| | |
|---|---|
| ***A41F 1/00*** | (2006.01) |
| ***A41B 1/10*** | (2006.01) |
| ***A41D 1/02*** | (2006.01) |
| ***A41D 1/04*** | (2006.01) |
| ***A41D 1/18*** | (2006.01) |
| ***A41D 3/02*** | (2006.01) |
| ***A41D 27/00*** | (2006.01) |

(52) U.S. Cl.

CPC ..... *A41F 1/002* (2013.01); *A41B 1/10* (2013.01); *A41D 1/02* (2013.01); *A41D 1/04* (2013.01); *A41D 1/18* (2013.01); *A41D 3/02* (2013.01); *A41D 27/00* (2013.01); *A41D 2300/30* (2013.01)

(58) Field of Classification Search

CPC ..... A41F 1/002; A41B 1/10; A44D 2203/00
USPC ..... 2/123
See application file for complete search history.

(56) References Cited

U.S. PATENT DOCUMENTS

| | | | |
|---|---|---|---|
| 999,539 | A | 8/1911 | Lauer, Jr. |
| 1,993,717 | A | 3/1935 | Hemmerich |
| 2,319,292 | A | 5/1943 | Boggs |
| 2,389,298 | A | 11/1945 | Ellis |
| 3,111,737 | A | 11/1963 | Heil |
| 3,141,216 | A | 7/1964 | Brett |
| 3,161,932 | A | 12/1964 | Russell |
| 3,827,319 | A | 7/1974 | Serbu |
| 4,249,237 | A | 2/1981 | Voss |
| 4,399,595 | A | 8/1983 | Yoon et al. |
| 5,782,191 | A | 7/1998 | Wong |
| 6,163,839 | A | 12/2000 | Tate |
| 6,226,842 | B1 | 5/2001 | Wong |
| 6,378,174 | B1 | 4/2002 | Wong |
| 6,868,556 | B1 | 3/2005 | Jenkins |
| 7,065,841 | B2 | 6/2006 | Sjoquist |

(Continued)

*Primary Examiner* — Sally Haden

(57) ABSTRACT

An article of clothing, such as a dress shirt, blouse, coat, jacket, or vest, includes a sheet of material forming a body portion. First and second plackets are formed along respective first and second end portions of the sheet of material. First and second magnetic elements, each being encased in an encasement, are secured inside first and second pockets, respectively, such that positions of the plurality of second magnetic elements correspond to positions of the plurality of first magnetic elements.

20 Claims, 19 Drawing Sheets

(56) References Cited

U.S. PATENT DOCUMENTS

| | | | |
|---|---|---|---|
| 8,539,349 | B1 | 9/2013 | Honeycutt |
| 8,631,517 | B1 | 1/2014 | Blakely |
| 2001/0014998 | A1 | 8/2001 | Grunberger |
| 2002/0178551 | A1 | 12/2002 | Hsu |
| 2003/0019008 | A1 | 1/2003 | Prather |
| 2004/0216212 | A1 | 11/2004 | Newman et al. |
| 2005/0108803 | A1 | 5/2005 | Ballard |
| 2005/0177985 | A1 | 8/2005 | Sjoquist |
| 2006/0252284 | A1 | 11/2006 | Marmaropoulos et al. |
| 2009/0178245 | A1 | 7/2009 | Albert |
| 2010/0167619 | A1 | 7/2010 | Adamus |
| 2010/0281597 | A1 | 11/2010 | Lang |
| 2011/0179605 | A1 | 7/2011 | Slank |
| 2012/0144544 | A1 | 6/2012 | Telfer et al. |
| 2012/0317702 | A1 | 12/2012 | Daly et al. |
| 2014/0259266 | A1 | 9/2014 | Federlin |
| 2014/0366242 | A1 | 12/2014 | Pulsifer |
| 2015/0040283 | A1 | 2/2015 | Moore |
| 2015/0047105 | A1 | 2/2015 | Fonzo |

ARTICLE OF CLOTHING HAVING MAGNETIC FASTENING ASSEMBLIES

CROSS REFERENCE TO RELATED APPLICATIONS

This application is a continuation of U.S. patent application Ser. No. 15/277,554 filed Sep. 27, 2016, a continuation of U.S. patent application Ser. No. 14/066,787 filed Oct. 30, 2013, now U.S. Pat. No. 9,549,580, a continuation-in-part of U.S. patent application Ser. No. 13/961,363 filed Aug. 7, 2013, a continuation-in-part of U.S. patent application Ser. No. 13/674,542 filed Nov. 12, 2012, now U.S. Pat. No. 9,210,953, each application being fully incorporated by reference herein.

TECHNICAL FIELD OF THE INVENTION

This invention relates to apparel and, more particularly, to a dress shirt, blouse, coat, jacket, vest, or medical gown having a single or multiple magnetic fastening assemblies.

BACKGROUND OF THE INVENTION

Typical dress shirts, blouses, coats, jackets, and/or vests are closed around a person's body by a zipper, snaps or a series of buttons that are secured in corresponding button holes. The cuffs of dress shirts, blouses, and jackets may also have closures with one or more buttons and button holes. To put on one of these articles of clothing, the buttons must be pushed through the button holes. And to take off the article of clothing, the buttons must be pushed back out of (or pulled through) the button holes. Pushing the buttons through the relatively small button holes requires dexterity and, thus, those who have limited control of their hands or fingers due to illness may experience difficulty closing and/or unfastening dress shirts or blouses. Young children having limited experience putting on clothing, or elderly individuals lacking full control of their hands, may also have difficulty putting on or taking off an article of clothing having buttons.

It is therefore an objective of this invention to provide an article of clothing, such as a dress shirt, blouse, coat, jacket, or vest, which may be quickly and easily put on and taken off by individuals, particularly those individuals having limited dexterity in their hands and/or fingers and young children who have not mastered using buttons.

It is another objective of this invention to provide an article of clothing, such as a dress shirt, blouse, coat, jacket, or vest, which may be quickly and easily put on or taken off, without passing buttons through holes.

It is another objective of this invention to provide an article of clothing, such as a dress shirt, blouse, coat, jacket, or vest, which uses multiple magnetic fastening assemblies to enable a person to quickly and easily put on or take off the article of clothing.

SUMMARY OF THE INVENTION

The invention of this application which accomplishes these objectives comprises an article of clothing, such as a dress shirt, blouse, coat, jacket, or vest having multiple magnetic fastening assemblies. The article of clothing includes a sheet of material or fabric that forms a body portion of the article. The sheet of material has first and second end portions. First and second plackets are formed along the first and second end portions, respectively. The first placket is formed by folding the sheet along the first end portion and securing the sheet to itself so as to form a first pocket. The second placket is formed by twice folding the sheet along the second end portion and securing the sheet to itself so as to form a second pocket. Alternatively, the second placket may be formed by coupling a strip of material to the second end portion of the sheet. The article of clothing further includes a plurality of spaced magnetic fastening assemblies, which include a plurality of first magnetic elements secured inside the first pocket and a plurality of second magnetic elements secured inside the second pocket. The first and second magnetic elements may be secured in the pockets by stitching together the surrounding layers. Thus, the first and second magnetic elements may be solid pieces. Positions of the plurality of second magnetic elements correspond to positions of the plurality of first magnetic elements. The first and second magnetic elements magnetically couple together in an engaged configuration. As a result of the positioning of the first and second magnetic elements within the respective first and second pockets, at least two layers of material lie between the first and second magnetic elements in the secured configuration. In any embodiment, the first and second magnetic elements may be encased in encasements.

Another embodiment of the invention that accomplishes these objectives comprises an article of clothing, such as a coat, jacket, vest, dress shirt, or blouse having a plurality of magnetic assemblies. The article of clothing includes a sheet of material forming a body portion, the sheet of material having first and second end portions. An inner sheet of material is coupled to an inside of the sheet of material, the inner sheet of material also having first and second end portions. First and second plackets are formed along respective first and second end portions of the sheet of material. The first placket is formed by folding the sheet of material along the first end portion so as to form first and second layers and securing together the first and second layers with the first end of the inner sheet of material therebetween. The second placket is formed by folding the sheet of material along the second end portion so as to form third and fourth layers and securing together the third and fourth layers with the second end of the inner sheet of material therebetween. A plurality of spaced magnetic fastening assemblies includes a plurality of first magnetic elements encased by encasements, and the encased magnetic assemblies are secured between the first layer and the inner sheet of material. The plurality of spaced magnetic fastening assemblies also includes a plurality of second magnetic elements encased by encasements, and the encased magnetic assemblies are secured between the third layer and the inner sheet of material, such that positions of the plurality of second magnetic elements correspond to positions of the plurality of first magnetic elements. The first layer and the inner sheet of material are sewn together so as to create a first line of stitching outside at least a portion of a perimeter of each encasement of each first magnetic assembly forming a first pocket that contains the first encased magnetic element therein. The third layers and the inner sheet of material are sewn together so as to create a second line of stitching outside at least a portion of a perimeter of each encasement of each second magnetic element forming a second pocket that contains the second encased magnetic element therein.

The article of clothing may also use a similar fastening assembly at a cuff of the article. The cuff may include a band of material having first and second end portions and inner and outer layers. The inner and outer layers are secured together so as to form a pocket between the layers. Alternatively, a piece of material may be coupled to the inner layer at each end portion so as to form a pocket at each end portion. The cuff also includes a magnetic fastening assembly having first and second magnetic elements. The first magnetic element is secured in the pocket at the first end portion of the band, and the second magnetic element is secured in the pocket at the second end portion of the band. In any embodiment, the first and second magnetic elements may be encased in encasements.

The magnetic fastening assemblies may also include a plurality of buttons coupled to the second placket on the main body portion of the article of clothing and/or on the cuff band. However, as the magnetic fastening assembly has a magnetic engagement, the purpose of the buttons is aesthetic; to provide the appearance of a regular shirt, blouse, coat or jacket, including faux button hole stitches.

In order to fasten the main body and/or the cuff of the article of clothing, one positions his/her arms in the sleeves of the article. He/she then aligns a first magnetic element with a corresponding second magnetic element and brings these first and second magnetic elements in close proximity so that they couple together. With respect to the fastening assembly of the main body portion, when an uppermost first element is magnetically coupled to an uppermost second element, first and second elements of the magnetic assemblies positioned below the uppermost first and second elements are configured to self-align and couple together. Thus, a person with limited dexterity may quickly and easily put on an article of clothing, such as a dress shirt, blouse, coat or jacket quickly and easily without assistance.

These and other advantages of the present invention will more readily become apparent from the description of the drawings herein, in which:

DETAILED DESCRIPTION OF THE INVENTION

Figure 1:
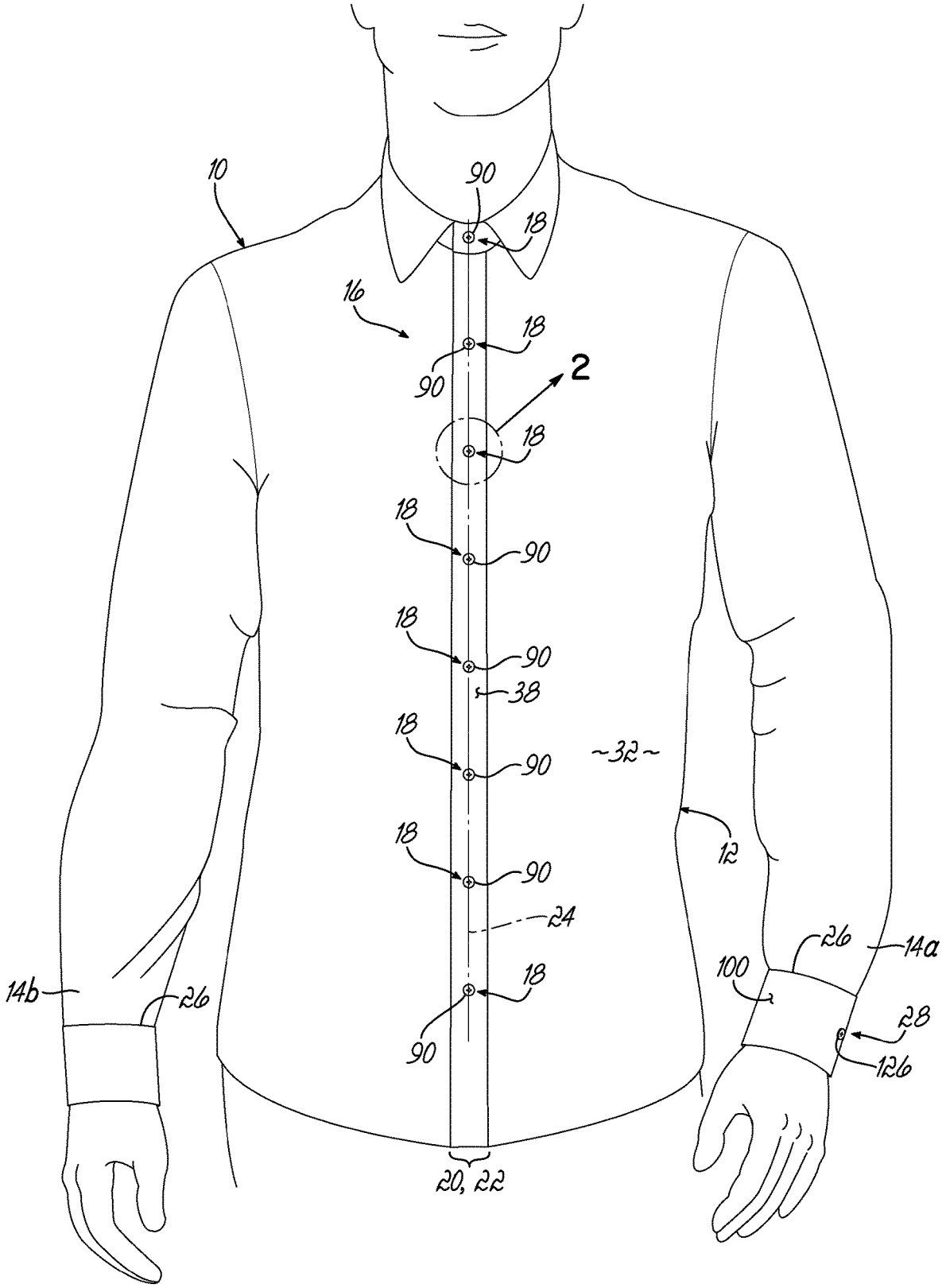
FIG. 1 is a front view of an article of clothing, such as a men's dress shirt according to aspects of the present invention.
Figure 1A:
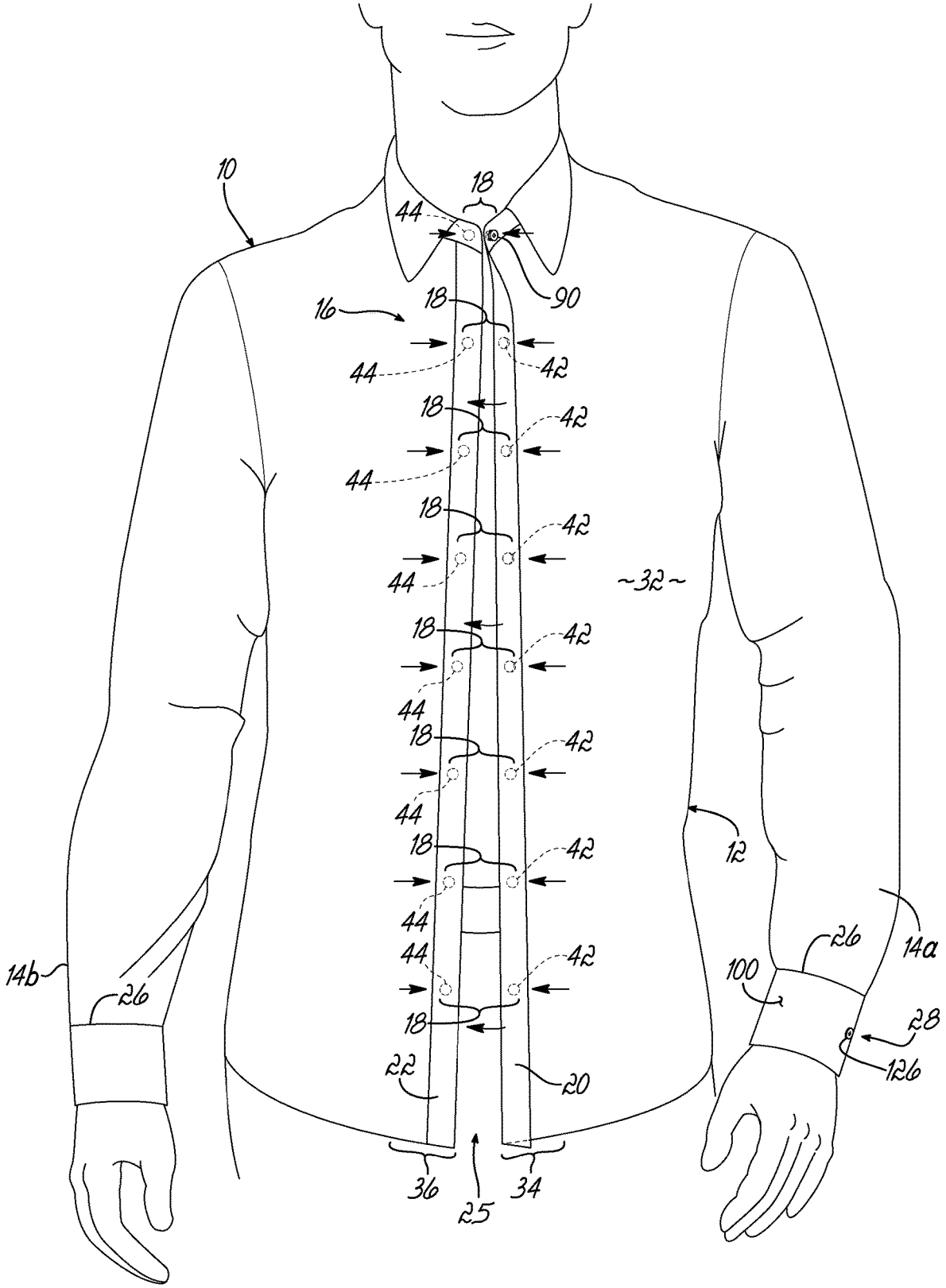
FIG. 1A is a front view of the men's dress shirt of FIG. 1 in which a plurality of magnetic fastening assemblies along a midline of the shirt are disengaged.

Referring to FIG. 1, an article of clothing 10 has a body portion 12 and two sleeves: a left sleeve 14*a* and a right sleeve 14*b*. The article of clothing 10 is illustrated as being a men's dress shirt, but may be a coat or jacket or similar article of clothing. On the body portion 12, a fastening assembly 16 has a plurality of magnetic fastening assemblies 18 positioned along plackets 20, 22 that run down a midline 24 of the article of clothing 10. As shown in FIG. 1A, the left side of the shirt has placket 20 and the right side of the shirt has placket 22. Although the embodiment shown in FIGS. 1 and 1A includes eight magnetic fastening assemblies 18 along the midline 24 of the article 10, the number of magnetic fastening assemblies 18 may vary depending on the size and style of the article 10, for example. In FIG. 1, all of the magnetic fastening assemblies 18 are engaged so as to close the article 10 around a person's body, the placket 20 overlying placket 22 so that the left placket 20 is outside the right placket 22. In FIG. 1A, the magnetic fastening assemblies 18 are disengaged, so that the article 10 is in an open position.

The article 10 may have a cuff 26 at the distal end of each sleeve 14*a*, 14*b*. Each cuff 26 may include at least one magnetic fastening assembly 28. Similar to the fastening assembly 16 along the midline 24 of the article 10, the number of magnetic fastening assemblies 28 on each cuff 26 may vary according to the size and style of the cuffs 26.

With further reference to FIGS. 1 and 1A, the main body portion 12 of the article 10 may be formed of a sheet of material or fabric 32 that is sized to fit around a person's body. As shown in FIG. 1A, the sheet of material 32 has end portions 34, 36 that form an opening 25 down the ventral portion of the article 10 when the article is open. The fastening assembly 16 includes plackets 20, 22 on the end portions 34, 36, respectively, of the sheet of material 32. The end portion 34 of the material 32 is on the left side of the shirt or article 10 proximate left sleeve 14*a*, and the end portion 36 of the material 32 is on the right side of the shirt or article 10 proximate right sleeve 14*b*.

Figure 2:
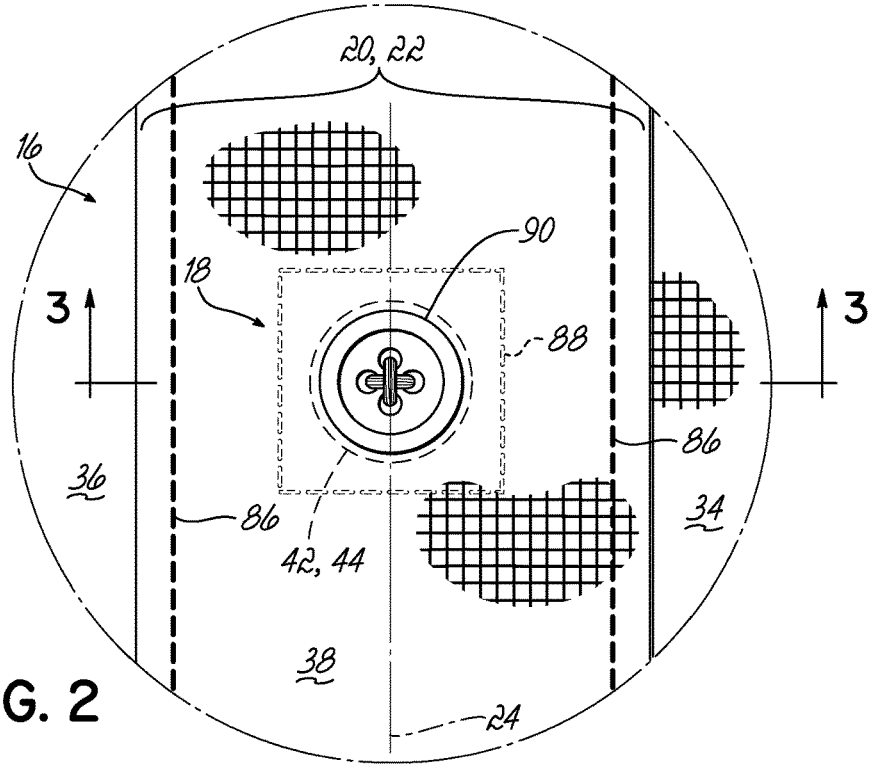
FIG. 2 is a magnified view of a portion of one of the magnetic fastening assemblies at encircled area 2 of FIG. 1.
Figure 3:
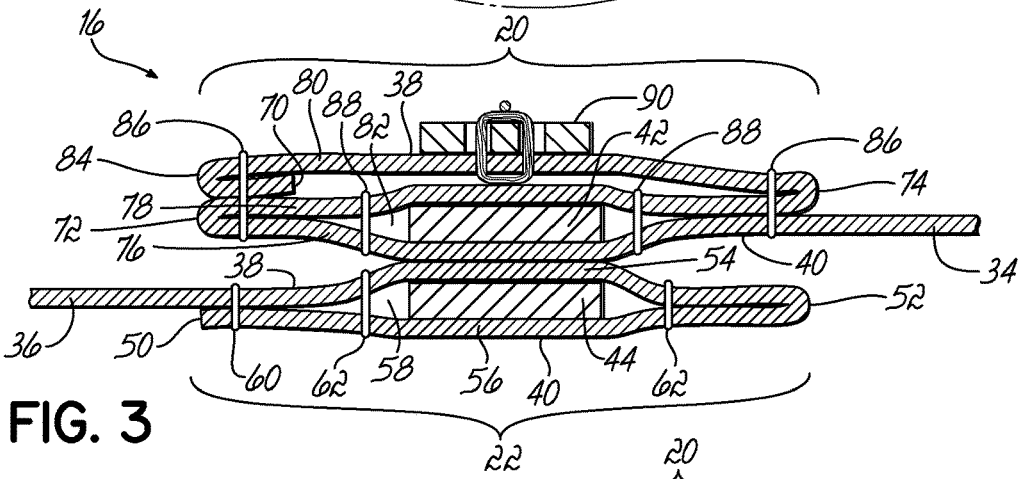
FIG. 3 is a cross-sectional view taken along line 3-3 of FIG. 2.
Figure 3A:
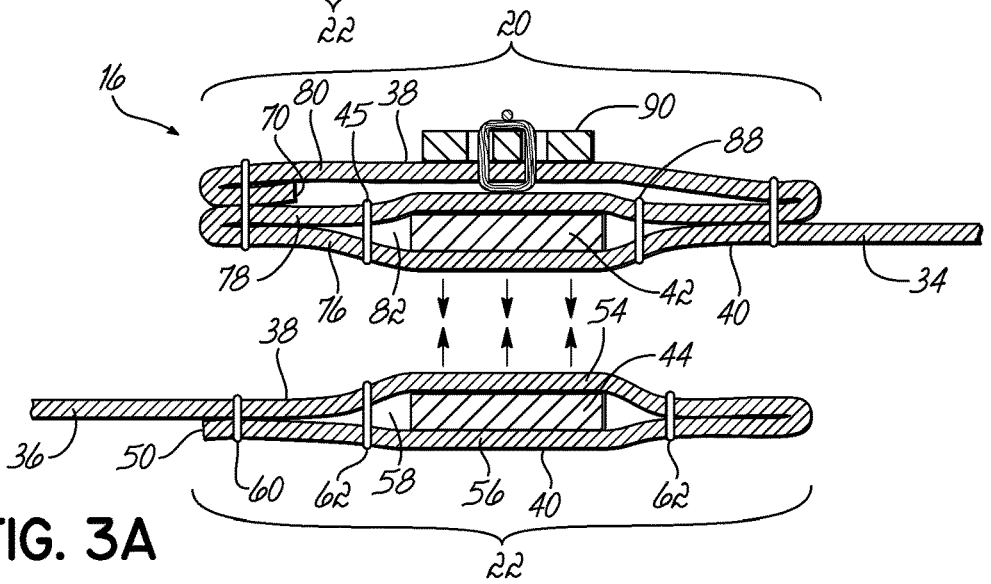
FIG. 3A is a cross-sectional view of the portion of the magnetic fastening assembly of FIG. 2A just prior to engagement.

As shown in FIGS. 2, 3 and 3A, each placket 20, 22 has an exterior surface 38, which faces away from the person's body, and an interior surface 40, which faces the person's body. The plackets 20, 22 may be integrally formed on the main body portion 12 of the article 10 by folding over end portions 34, 36 of the sheet of material 32, so as to form French plackets. Alternatively, the plackets 20, 22 may comprise separate strips of material that are sewn onto or otherwise coupled to the sheet of material 32. Each placket 20, 22 may comprise two or more layers of material that are sewn or otherwise coupled together. By having two or more layers, the plackets 20, 22 are reinforced and may have increased durability. On article 10, the left placket 20 is designed to be positioned on top of the right placket 22 in the closed position. In this way, when in a closed position, the interior surface 40 of the left placket 20 faces and is positioned substantially adjacent to the exterior surface 38 of the right placket 22. Due to the magnetic function of the fastening assembly 16, the plackets 20, 22 may be solid pieces of material, without button holes therethrough.

Figure 2A:
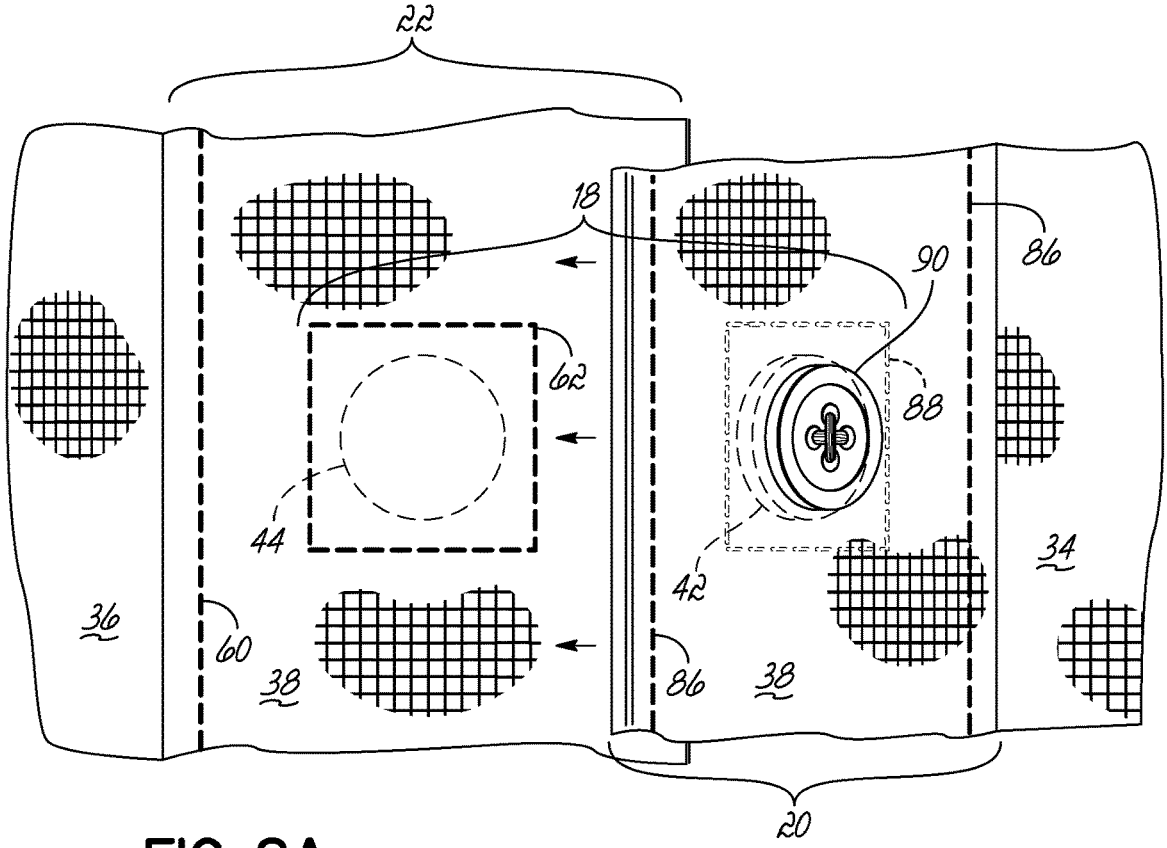
FIG. 2A is a magnified view of the portion of the magnetic fastening assembly of FIG. 2 in a disengaged configuration.
Figure 6:
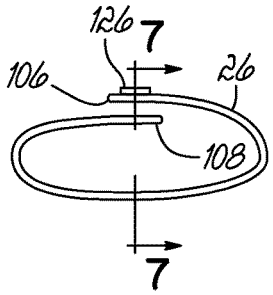
FIG. 6 is a schematic cross sectional view of a full cuff similar to that shown in FIG. 4.
Figure 7:
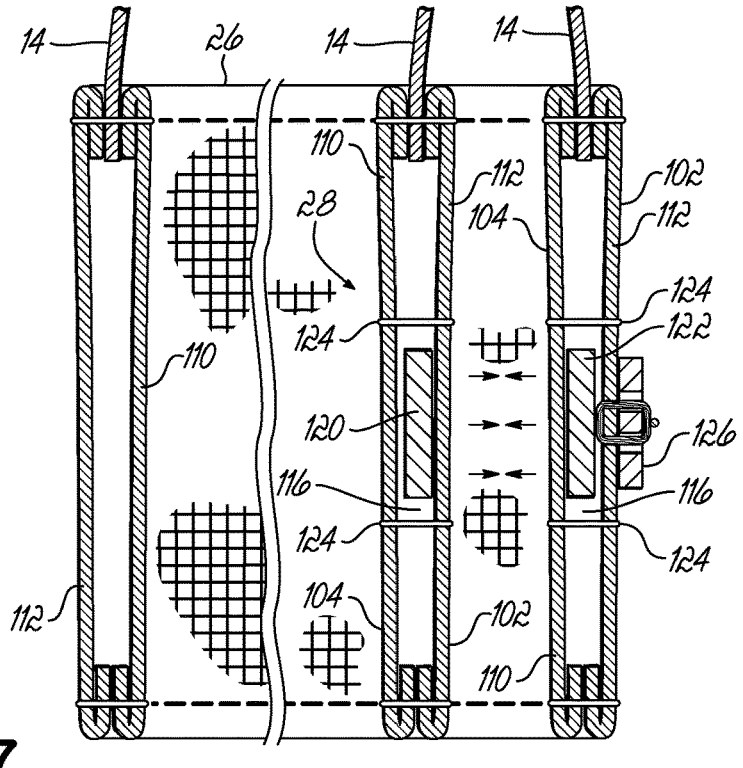
FIG. 7 is a cross sectional view taken along line 7-7 of the fastening assembly of FIG. 6.

With respect to FIGS. 2-3A, a magnified view of a portion of the fastening assembly 16 at the midline 20 of the article 10 is shown. FIGS. 2 and 2A show the portion of the fastening assembly 16 in engaged and disengaged configurations, respectively. The fastening assembly 16 includes at least one magnetic fastening assembly 18 having two solid magnetic elements 42, 44 without openings therethrough. One magnetic element 42 is associated with the left placket of the article 10, and another magnetic element 44 is associated with the right placket 22 of the article 10.

At least one of the magnetic elements 42, 44 is a magnet. The magnet may be an axially magnetized neodymium magnet, for example. One suitable magnet is an N52 magnet sold by K&J Magnetics, Inc., for example. The magnet may have a maximum energy product (BHmax) of at least 49.5-52 megagauss-oersteds (MGOe). The magnet should be strong enough so that the fastening assembly 16 remains closed during normal wear of the article of clothing 10. However, the magnet should not be so strong as to prevent disengagement or cause undue exertion when the wearer wishes to disengage the fastening assembly to take off the article 10. It should be noted that due to the magnetic properties of the magnetic assembly 18, the fastening assembly 16 may not be safe for use on dress shirts or articles worn by people with pacemakers.

The magnet may be plated so as to help prevent corrosion and/or to help strengthen the magnet material. In one embodiment, a neodymium magnet is coated with nickel or plastic, yet other options for coatings include zinc, tin, copper, epoxy, silver, and gold, for example. Moreover, one or both of the magnetic elements 42, 44 may be encased in plastic, as described below with respect to FIGS. 11-16. Finally, although a standard temperature magnet is likely sufficient for use in the magnetic fastening assembly 18 for the article 10, a magnet having a temperature rating that enables the magnet to be employed at an increased operating temperature may also be used.

The other magnetic element 42, 44 may be another magnet having an opposite polarity than the first magnetic element 42, 44 or a metallic article that is magnetically attracted to the first magnetic element 42, 44. The two magnetic elements 40, 42 may have the same size and shape. In the embodiment shown in FIGS. 2-3A, the magnetic elements 40, 42 are disc-shaped. For example, the magnet may have a diameter of approximately 7/16" and a thickness of approximately 1/16". However, one of ordinary skill will recognize that a variety of sizes and/or shapes may be used for the magnetic elements 40, 42 and that the sizes and/or shapes of the two magnetic elements 40, 42 need not be identical.

In the embodiment of the fastening assembly 16 shown in FIGS. 3 and 3A, the right placket 22 is formed from the sheet of material 32 that forms the main body portion 12 of the article 10. An end portion 36 of the sheet of material 32 is folded at point 52 toward the interior and distal from the midline 24 so as to form a placket 22 with two layers 54, 56. The two layers 54, 56 are coupled together so as to form a pocket 58 between the two layers 54, 56. In the embodiment shown, a line of stitching 60 couples the folded end portion 36 to the sheet of material 32 proximate an end 50 of the sheet of material 32. Alternatively, the right placket 22 may comprise a strip of material that is folded to create the two layers 54, 56, which is then coupled to the sheet of material 32. Or the right placket 22 may comprise two strips of material that are coupled together to create the two layers 54, 56, which are then coupled to the sheet of material 32. One of ordinary skill in the art will recognize that the layers 54, 56 may be coupled to each other and/or to the sheet of material 32 by stitching or by any other satisfactory method.

A plurality of magnetic elements 44 of the magnetic assembly 18 may be positioned at predetermined locations in the pocket 58 between the two layers 54, 56 of material in the right placket 22. The magnetic elements 44 may be evenly spaced or spaced at varying intervals. Each magnetic element 44 may be secured in the proper position by sewing together the two layers 54, 56 outside at least a portion of the perimeter of the magnetic element 44. A resulting line of stitching 62 may form a rectangle around the magnetic element 44, may have the same shape as the magnetic element 44, or it may have any other shape suitable for restricting movement of the magnetic element 44 within the pocket 58. The line of stitching 62 around the magnetic element 44 indirectly couples the magnetic element 44 to the placket 22. In this way, it is not necessary to sew through the magnetic element 44 itself and, thus, the magnetic element 44 may be solid piece without holes therethrough.

With further reference to the embodiment shown in FIGS. 3 and 3A, the left placket 20 is also formed from the same sheet of material 32, at a left end portion 34 thereof. The end portion 34 is folded once at point 72 toward the exterior and distal from the midline 24 and then folded again at point 74 toward the exterior and proximal to the midline 24. As a result of the double fold, a three-layer placket is formed. These layers 76, 78, 80 may be described as an inside layer 76, which is closest to the body when worn; an outside layer 80, which is furthest from the body when worn; and a middle layer 78, which lies between the inside and outer layers 76, 80. The three layers 76, 78, 80 may be coupled together so as to create at least one pocket 82 between two adjacent layers. Finally, an edge 70 of the sheet of material 32 may also be folded toward the interior at point 84, such that the edge 70 lies within a pocket between the layers 78, 80 and, thus, is not exposed at an exterior surface 38 of the placket 20. Folding edge 70 toward the interior at point 84 may help prevent the edge 70 from fraying. In the embodiment shown, a line of stitching 86 may couple the layers 76, 78, 80 and the edge 70 proximate the fold points 72, 84 and couple the layers 76, 78, 80 to the sheet of material 32 proximate the fold point 74. Similar to the right placket 22, the left placket 20 may alternatively comprise a strip of material that is folded to create three layers 76, 78, 80, the strip then being coupled to the sheet of material 32. Or the right placket 20 may comprise two or three strips of material that are coupled together to create three layers 76, 78, 80, which are then coupled to the dress shirt 10. One of ordinary skill will recognize that the layers 76, 78, 80 may be coupled to each other and/or to the sheet of material 32 by stitching or by any other satisfactory method.

A plurality of magnetic elements 42 of the magnetic assembly 18 may be positioned at predetermined locations in the pocket 82 between the layers 76, 78, 80 of material in the left placket 20. The locations of the magnetic elements 42 should correspond to the locations of the magnetic elements 44, and like the magnetic elements 44, the magnetic elements 42 may be evenly spaced or spaced at varying intervals. In the embodiment shown in FIGS. 3 and 3A, the magnetic element 42 is positioned between the inside layer 76 and the middle layer 78. However, the magnetic element 42 may alternatively be positioned between the middle layer 78 and the outside layer 80, so long as the magnetic attraction is strong enough to pass through an additional layer of material (i.e., both the inside and middle layers 76, 78). The magnetic element 42 may be secured in the proper position by stitching together the two surrounding layers 76, 78, 80 to form a line of stitching 88 outside at least a portion of the perimeter of the magnetic element 42 in the same manner as described above with respect to the right placket 22.

With further reference to FIGS. 2-3A, a button 90 may be coupled to the exterior surface 38 of the outside layer 80. The button 90 may be positioned immediately on top of the magnetic element 42, or the button 90 may be positioned at a distance from the magnetic element 42. The button 90 may be sewn onto the outside layer 80 or coupled thereto in any other way known to one of ordinary skill. The button 90 may be considered a "faux button" because it does not have a fastening or securing function for the article 10. The button 90 is provided for aesthetic purposes and to give the appearance of a functional button. Although a four-hole button 90 is shown in the illustrated embodiment, one of ordinary skill will recognize that any type of button 90 may be used.

Figure 4:
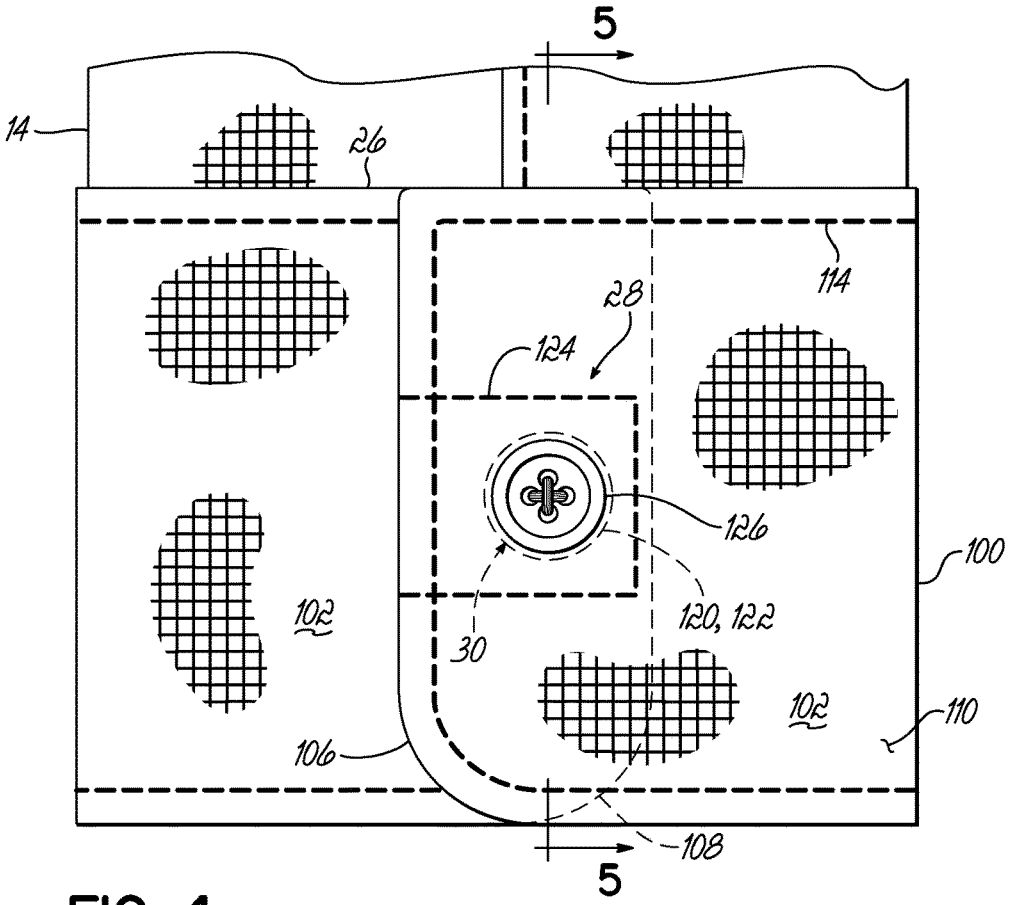
FIG. 4 is a front view of a cuff of an article of clothing, such as a dress shirt having a magnetic fastening assembly.
Figure 5:
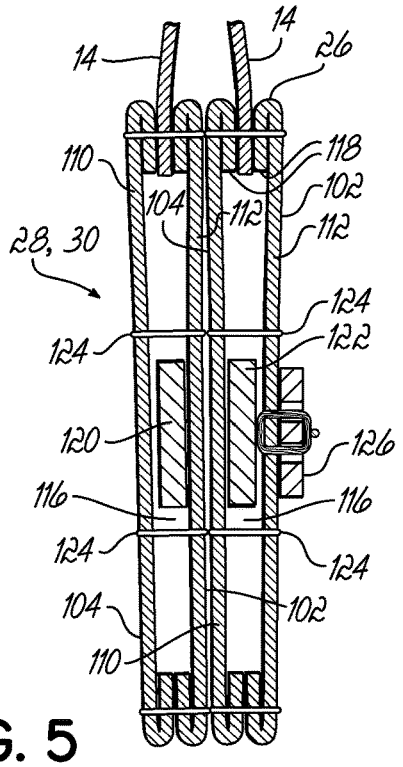
FIG. 5 is a cross-sectional view taken along line 5-5 of the fastening assembly of FIG. 4.

With reference to FIGS. 4-7, a similar fastening assembly as that described above with respect to the main body portion 12 of the article 10 may also be used on the cuffs 26. A cuff 26 may comprise a band 100 of material that is coupled to a distal portion of a sleeve 14. The band 100 has an exterior surface 102, which faces away from the person's body, and an interior surface 104, which faces the person's body. The band 100 may be considered to have two end portions 106, 108 adjacent an opening of the cuff 26. The band 100 may be formed from two layers 110, 112 of material of substantially the same size that are sewn or otherwise coupled together. For example, the two layers 110, 112 may be coupled by a seam 114 proximate the perimeters of the layers 110, 112. Alternatively, the band 100 may be formed from a single piece of material that is folded lengthwise so as to create two layers 110, 112, which are then coupled together. In the embodiment shown in FIG. 5, the material at the distal portion of the sleeve 14 is sewn in between the two layers 110, 112 of the band 100, so as to secure the band 100 to the sleeve 14. One of ordinary skill will recognize that the band 100 may be secured to the sleeve 14 in a variety of ways. Regardless of how the two layers 110, 112 are formed and secured to the sleeve 14, at least one pocket 116 is formed between the two layers 110, 112. Moreover, as shown in the embodiment of FIG. 5, one or more edges 118 of the layers 110, 112 of material may be folded toward the pocket 116 of the band 100 so that the edges 118 are not exposed at the exterior or interior surfaces 102, 104 of the band 100. Such folding may help prevent fraying of the edges 118.

Similar to the magnetic assembly 18 described above, the fastening assembly 28 for the cuff 26 may also include a magnetic assembly 30 having two magnetic elements 120, 122. One magnetic element 120 of the magnetic assembly 30 may be coupled to one end portion 106 of the band 100, and another magnetic element 122 of the magnetic assembly 30 may be coupled to the other end portion 108 of the band 100. The magnetic elements 120, 122 may be positioned in the pocket 116 between the two layers 100, 112 of material, and sewing together the two layers 110, 112 in a line of stitching 124 around the magnetic elements 120, 122 may secure the magnetic elements 120, 122 in substantially stationary positions. As described above with respect to the plackets 20, 22, the line of stitching 124 may have a variety of different shapes around at least a portion of the perimeter of the magnetic element 120, 122. A button 126 may be coupled to an exterior surface 102 of the band 100 at the end portion 106 thereof. The button 126 may be secured on the cuff 26 in the manner described above with respect to button 90.

In the embodiment of the cuff 26 shown in FIG. 4, when the magnetic elements 120, 122 of the magnetic assembly 30 are coupled together, one end portion 106 of the band 100 overlaps the other end portion 108 of the band 100, as is common with traditional button cuffs. With the magnetic fastening assembly 28, the band 100 may be a solid piece, without button holes. However, one may use the fastening assembly 28 of the present invention for link cuffs, including single cuffs, French cuffs, or convertible cuffs, as well.

An article 10 may include a fastening assembly 16 on a body portion 12 and/or a fastening assembly 28 on each of the cuffs 26. In use, after one positions his/her arms in the sleeves 14, he/she aligns an uppermost magnetic element 42 on the left placket 20 with the corresponding magnetic element 44 on the right placket 22. By bringing the uppermost magnetic elements 42, 44 in close proximity to one another, they become magnetically coupled together. Moreover, once the magnetic elements 42, 44 of the uppermost magnetic assembly 18 are aligned, the magnetic elements 42, 44 of the remaining magnetic assemblies 18 may fall into place, self-align, and automatically magnetically couple together. Accordingly, little dexterity is required to secure the fastening assembly 16 of the article 10.

To close the cuffs 26 of the article 10, the person aligns the magnetic element 120 on one end portion 106 of the cuff band 100 with the magnetic element 122 on the other end portion 108 of the cuff band 100 so that the magnetic elements 120, 122 magnetically couple together when they are brought in close proximity to one another. If there is more than one magnetic assembly 30 on each cuff 26, once the magnetic elements 120, 122 of the first magnetic assembly 30 are aligned, any subsequent magnetic assemblies 30 may self-align and magnetically couple together as well. In the embodiment in which buttons 90, 126 are coupled to exterior surfaces 38, 102 of the left placket 20 and/or cuffs 26, the article 10 will have an appearance of a regular dress shirt, coat, jacket, etc.

In the engaged configuration, at least two layers of material are positioned between the two magnetic elements of the magnetic assembly. Accordingly, the magnetic elements 42, 44 or 120, 122 are not in direct contact with each other. Although the magnetic assemblies 18, 30 have strong enough magnetic properties to maintain the fastening assemblies 16, 28 in engaged configurations while the article 10 is worn, the magnetic assemblies 18, 30 may be disengaged with a reasonable amount of force. Therefore, to remove the dress shirt 10, the person simply pulls apart the magnetic elements 42, 44 or 120, 122 of the magnetic assembly 18, 30. With respect to the magnetic assemblies 18 on the plackets 20, 22 of the article 10, one may separate the magnetic elements 42, 44, for example, by pulling the left placket 20 away from the body or away from the midline 24. The buttons 90, 126 may also be gripped to separate the elements 42, 44 or 120, 122. Accordingly, little dexterity is required to disengage the fastening assembly 16 of the article 10.

Figure 8:
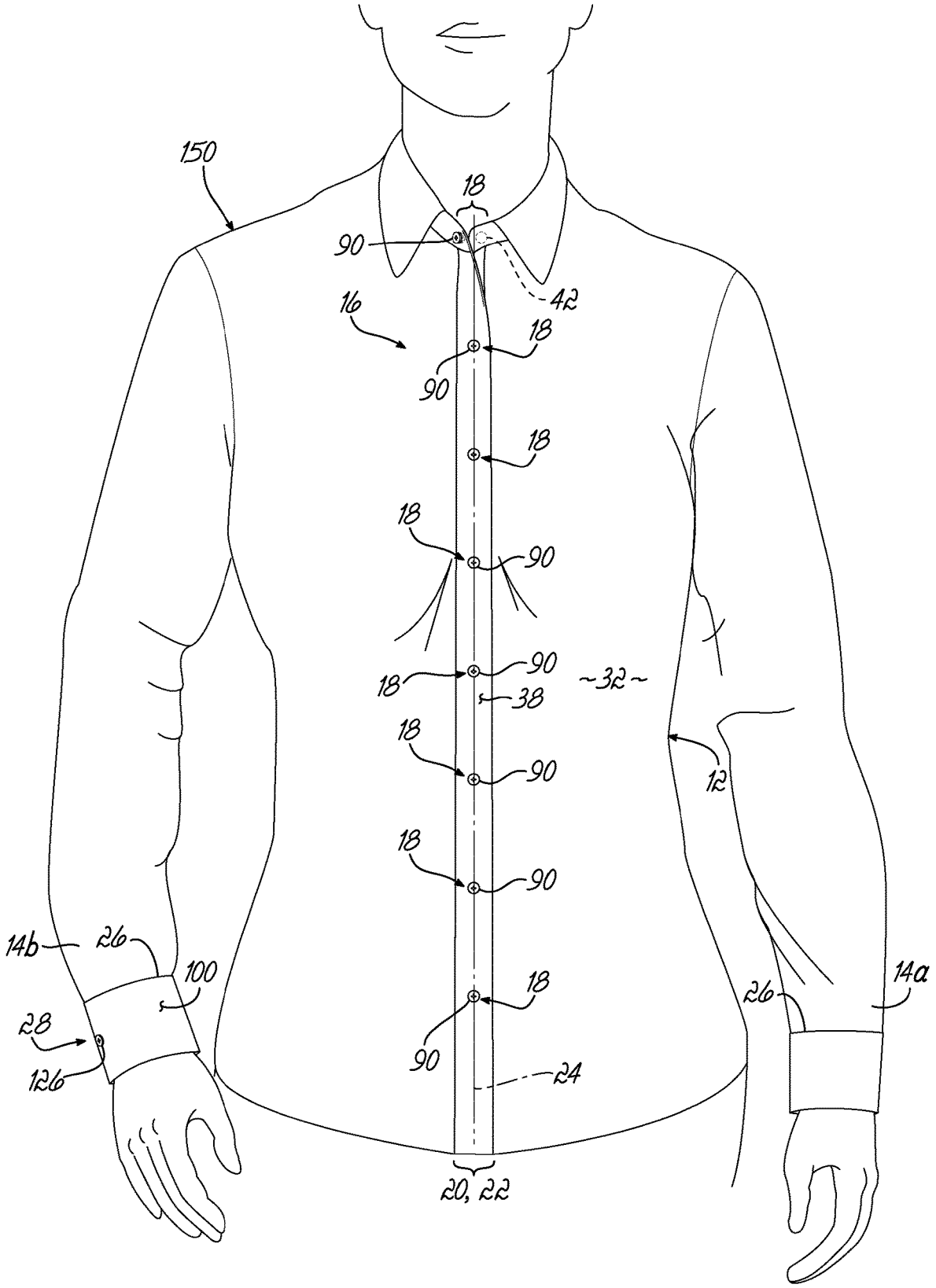
FIG. 8 is a front view of an article of clothing, such as a women's blouse according to aspects of the present invention.

FIG. 8 shows a fastening assembly 16 on an article of clothing shown as a women's blouse 150. The fastening assembly 16 functions the same way on a women's blouse 150 as on a men's dress shirt 10, but fewer magnetic assemblies 18 may be used and/or the magnetic assemblies 18 may be positioned closer together on the women's blouse 150 than on the men's dress shirt 10.

Figure 9:
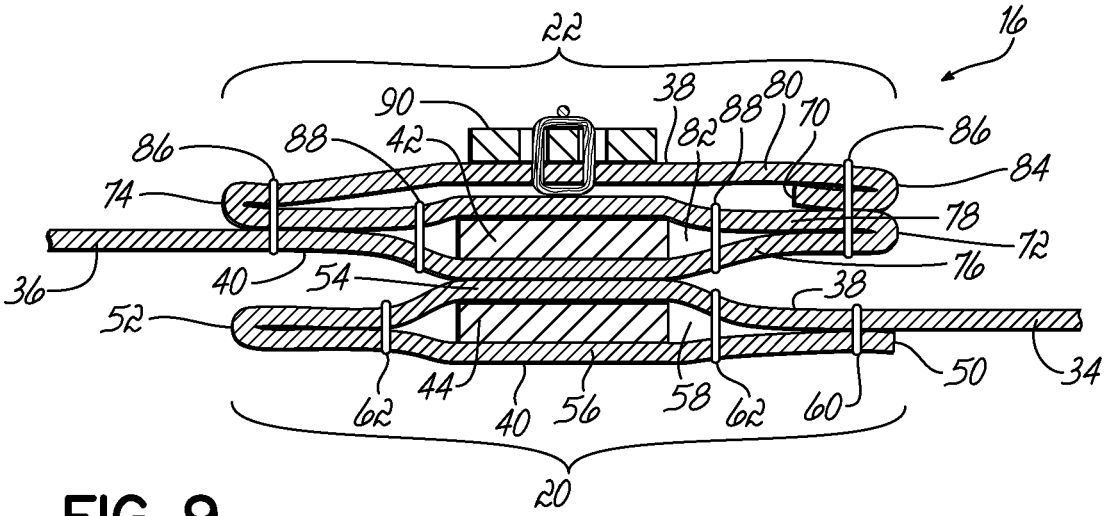
FIG. 9 is a cross-sectional view like FIG. 3 of the blouse of FIG. 8.

As shown in FIG. 9, the main difference between the women's blouse 150 and the men's dress shirt 10 is that the right placket 22 is designed to be positioned on top of the left placket 20 in the engaged configuration for a women's blouse 150. In this way, the interior surface 40 of the right placket 22 faces and is positioned substantially adjacent the exterior surface 38 of the left placket 20. On article 150, the right placket 22 is designed to be positioned on top of the left placket 20 in the closed position. Due to the magnetic function of the fastening assembly 16, the plackets 20, 22 may be solid pieces of material, without button holes therethrough.

In the embodiment of the fastening assembly 16 shown in FIGS. 8 and 9, the left placket 20 is formed from the sheet of material 32 that forms the main body portion 12 of the article 150. An end portion 34 of the sheet of material 32 is folded at point 52 toward the interior and distal from the midline 24 so as to form a placket 20 with two layers 54, 56. The two layers 54, 56 are coupled together so as to form a pocket 58 between the two layers 54, 56. In the embodiment shown, a line of stitching 60 couples the folded end portion 36 to the sheet of material 32 proximate an end 50 of the sheet of material 32. Alternatively, the left placket 20 may comprise a strip of material that is folded to create the two layers 54, 56, which is then coupled to the sheet of material 32. Or the left placket 20 may comprise two strips of material that are coupled together to create the two layers 54, 56, which are then coupled to the sheet of material 32. One of ordinary skill in the art will recognize that the layers 54, 56 may be coupled to each other and/or to the sheet of material 32 by stitching or by any other satisfactory method.

A plurality of magnetic elements 44 of the magnetic assembly 18 may be positioned at predetermined locations in the pocket 58 between the two layers 54, 56 of material in the left placket 20. The magnetic elements 44 may be evenly spaced or spaced at varying intervals. Each magnetic element 44 may be secured in the proper position by sewing together the two layers 54, 56 outside at least a portion of the perimeter of the magnetic element 44. A resulting line of stitching 62 may form a rectangle around the magnetic element 44, may have the same shape as the magnetic element 44, or it may have any other shape suitable for restricting movement of the magnetic element 44 within the pocket 58. The line of stitching 62 around the magnetic element 44 indirectly couples the magnetic element 44 to the placket 22. In this way, it is not necessary to sew through the magnetic element 44 itself and, thus, the magnetic element 44 may be a solid piece without holes therethrough.

With further reference to the embodiment shown in FIGS. 8 and 9, the right placket 22 is also formed from the same sheet of material 32, at a right end portion 36 thereof. The end portion 36 is folded once at point 72 toward the exterior and distal from the midline 24 and then folded again at point 74 toward the exterior and proximal to the midline 24. As a result of the double fold, a three-layer placket is formed. These layers 76, 78, 80 may be described as an inside layer 76, which is closest to the body when worn; an outside layer 80, which is furthest from the body when worn; and a middle layer 78, which lies between the inside and outer layers 76, 80. The three layers 76, 78, 80 may be coupled together so as to create at least one pocket 82 between two adjacent layers. Finally, an edge 70 of the sheet of material 32 may also be folded toward the interior at point 84, such that the edge 70 lies within a pocket between the layers 78, 80 and, thus, is not exposed at an exterior surface 38 of the placket 22. Folding edge 70 toward the interior at point 84 may help prevent the edge 70 from fraying. In the embodiment shown, a line of stitching 86 may couple the layers 76, 78, 80 and the edge 70 proximate the fold points 72, 84 and couple the layers 76, 78, 80 to the sheet of material 32 proximate the fold point 74. Similar to the left placket 20, the right placket 22 may alternatively comprise a strip of material that is folded to create three layers 76, 78, 80, the strip then being coupled to the sheet of material 32. Or the left placket 22 may comprise two or three strips of material that are coupled together to create three layers 76, 78, 80, which are then coupled to the dress shirt 10. One of ordinary skill will recognize that the layers 76, 78, 80 may be coupled to each other and/or to the sheet of material 32 by stitching or by any other satisfactory method.

A plurality of magnetic elements 42 of the magnetic assembly 18 may be positioned at predetermined locations in the pocket 82 between the layers 76, 78, 80 of material in the right placket 22. The locations of the magnetic elements 42 should correspond to the locations of the magnetic elements 44, and like the magnetic elements 44, the magnetic elements 42 may be evenly spaced or spaced at varying intervals. In the embodiment shown in FIGS. 8 and 9, the magnetic element 42 is positioned between the inside layer 76 and the middle layer 78. However, the magnetic element 42 may alternatively be positioned between the middle layer 78 and the outside layer 80, so long as the magnetic attraction is strong enough to pass through an additional layer of material (i.e., both the inside and middle layers 76, 78). The magnetic element 42 may be secured in the proper position by stitching together the two surrounding layers 76, 78, 80 to form a line of stitching 88 outside at least a portion of the perimeter of the magnetic element 42 in the same manner as described above with respect to the left placket 20.

The blouse 150 (or the dress shirt 10, for that matter) may not include buttons 90 at all, or the buttons 90 may be concealed by an additional placket of material that is positioned over the buttons 90. The same may be true on a coat or jacket like the jacket shown in FIG. 10.

Figure 10:
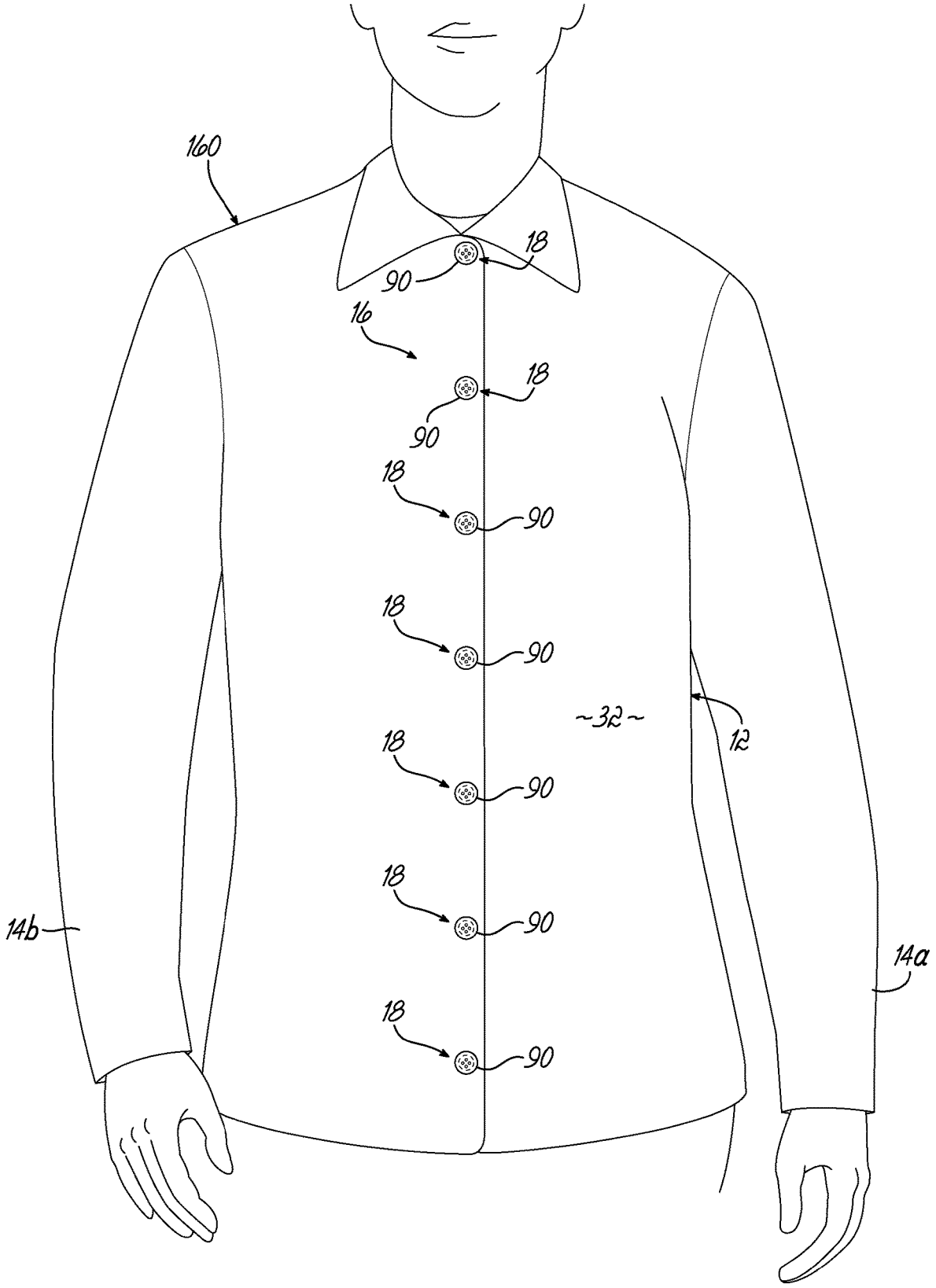
FIG. 10 is a front view of an article of clothing, such as a jacket, according to aspects of the present invention.

FIG. 10 shows a fastening assembly 16 on an article of clothing shown as a jacket 160. The fastening assembly 16 functions the same way on a jacket 160 as on the women's blouse 150, but more magnetic assemblies 18 may be used and/or the magnetic assemblies 18 may be positioned closer together on the jacket 160 than on the women's blouse 150. The main difference between the jacket 160 and the men's dress shirt 10 is that the right placket 22 is designed to be positioned on top of the left placket 20 in the engaged configuration for a jacket 160, like for the women's blouse 150. In this way, the interior surface 40 of the right placket 22 faces and is positioned substantially adjacent the exterior surface 38 of the left placket 20. As shown in FIG. 10, the jacket 160 may lack cuffs on the left and right sleeves, 14*a*, 14*b*, respectively.

Figure 11:
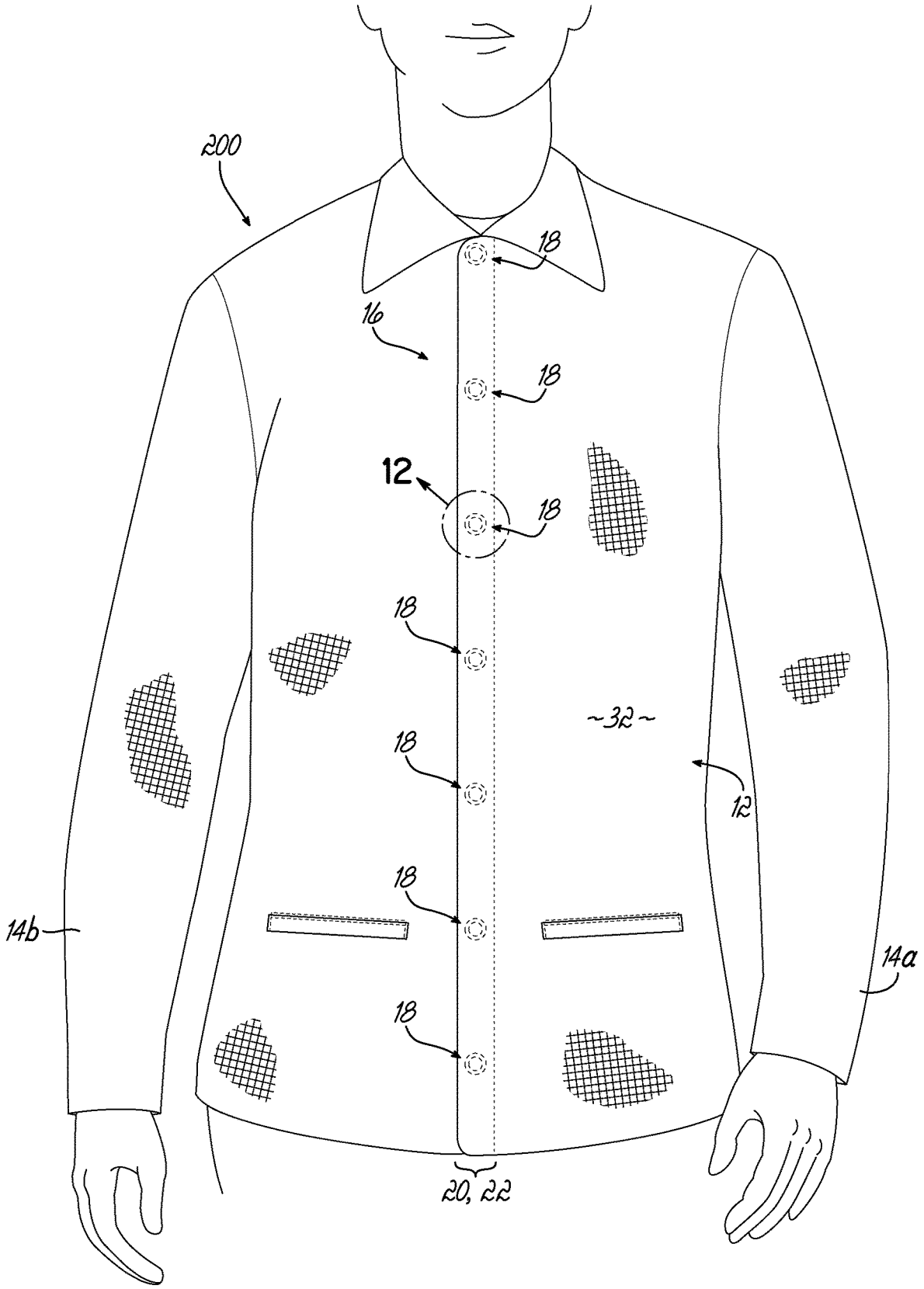
FIG. 11 is a front view of an article of clothing, such as a coat, according to aspects of the present invention.

With reference now to FIGS. 11-16, another embodiment of the fastening assembly 16 is shown. While a coat 200 is illustrated in FIG. 11, a person of ordinary skill will recognize that the fastening assembly 16 described below may be used in any article of clothing including a vest. The fastening assembly 16 functions similarly to the men's dress shirt 10 or other articles of clothing described above, but a different embodiment of the magnetic assemblies 18 is used. The body portion 12 of the coat 200 includes the same features, which are referred to by the same reference numerals, as the men's dress shirt 10, unless indicated otherwise.

Figure 12:
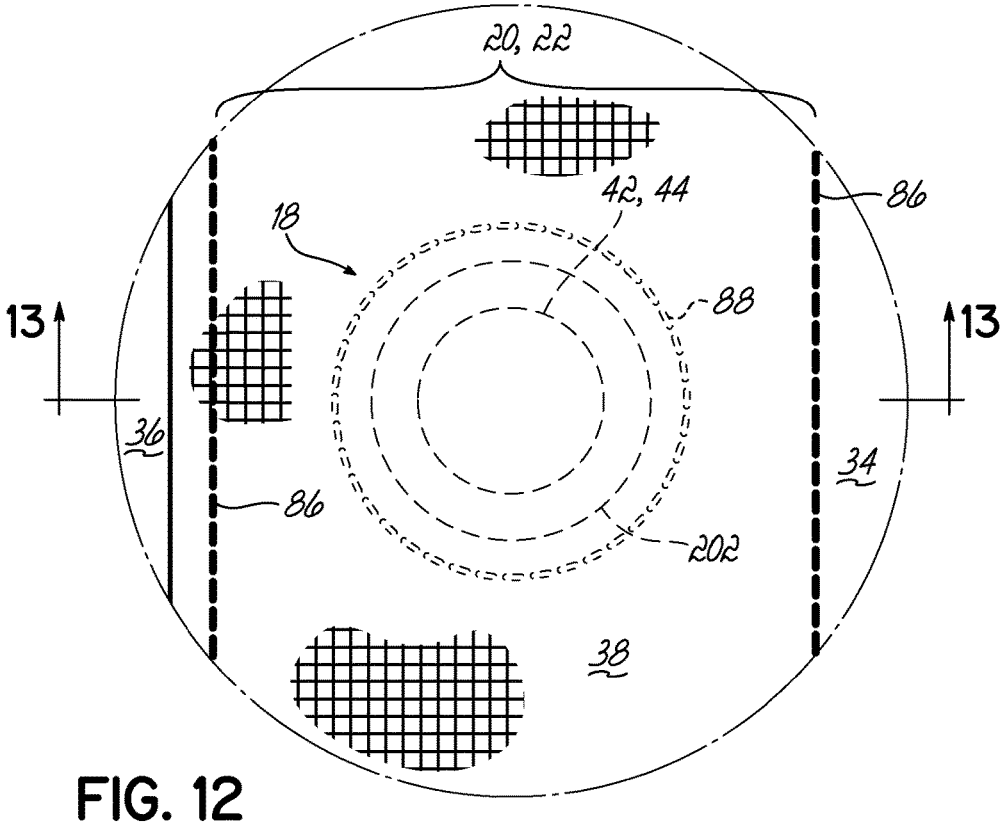
FIG. 12 is a magnified view of a portion of a magnetic fastening assembly at encircled area 12 of FIG. 11.
Figure 13:
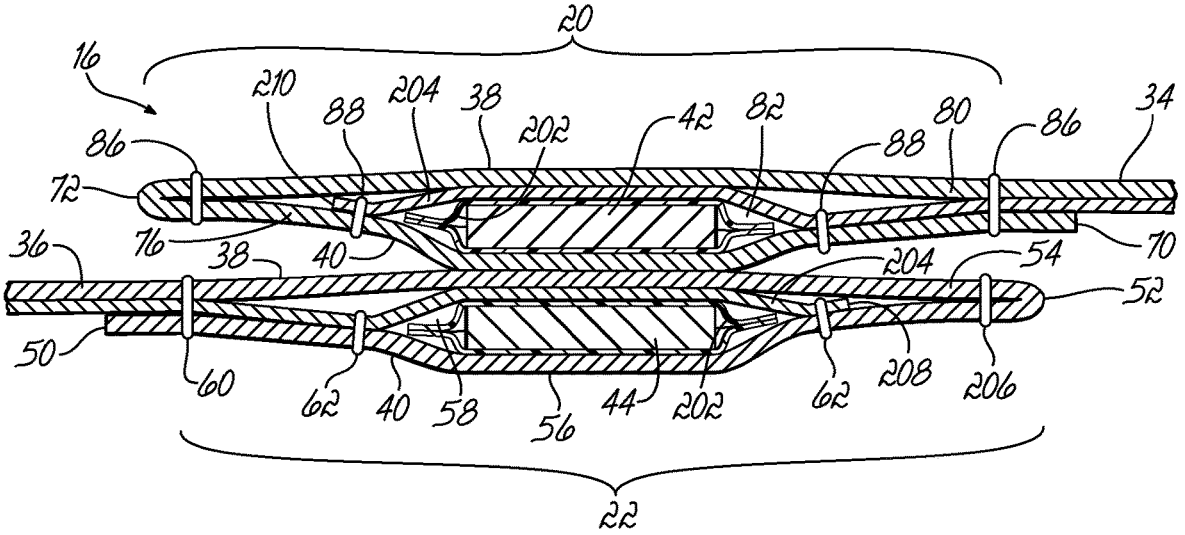
FIG. 13 is a cross-sectional view taken along line 13-13 of FIG. 12.
Figure 14:
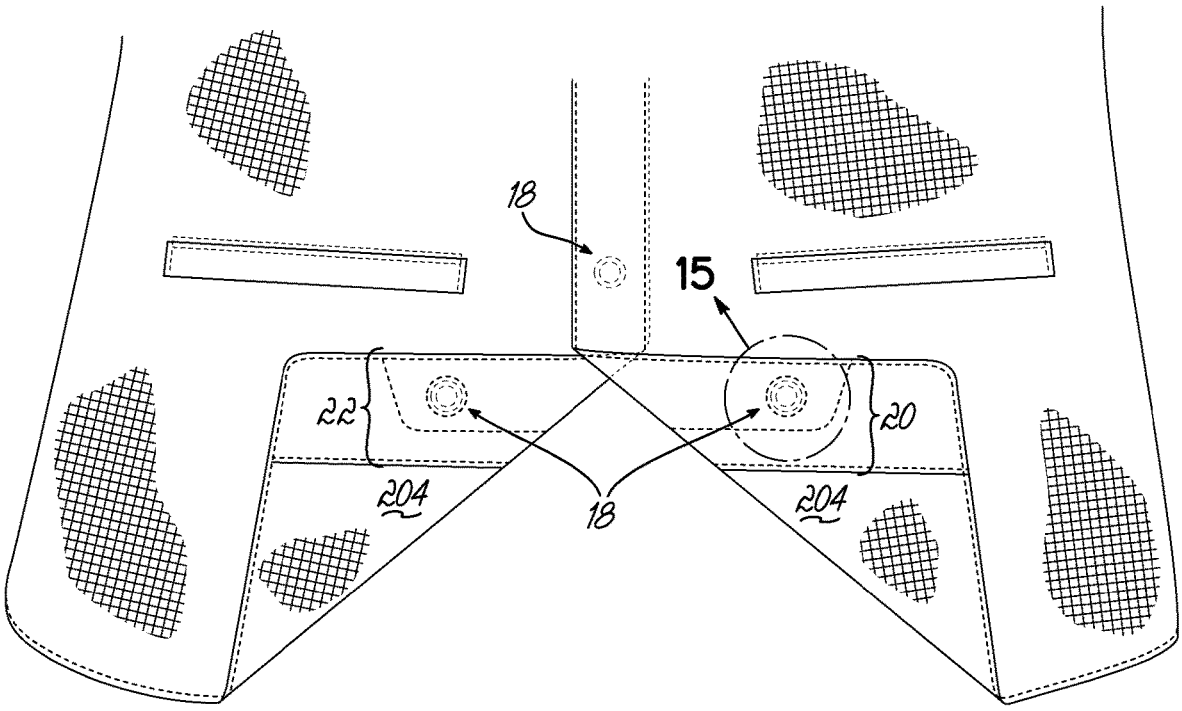
FIG. 14 is a magnified view of a portion of the article of clothing of FIG. 10, showing one of the magnetic fastening assemblies in a disengaged configuration.
Figure 15:
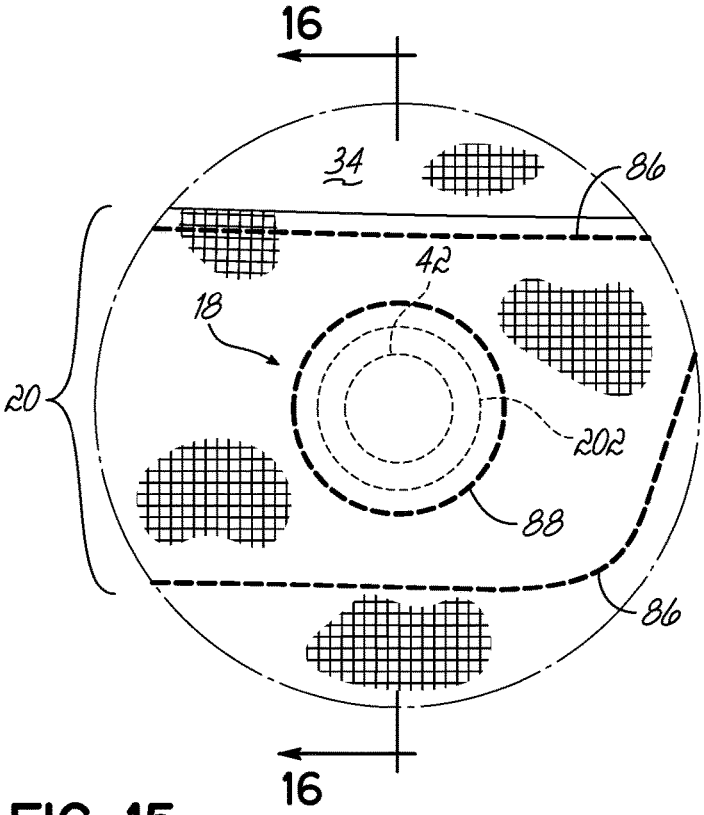
FIG. 15 is a magnified view of a portion of a magnetic assembly at encircled area 15 of FIG. 14.
Figure 16:
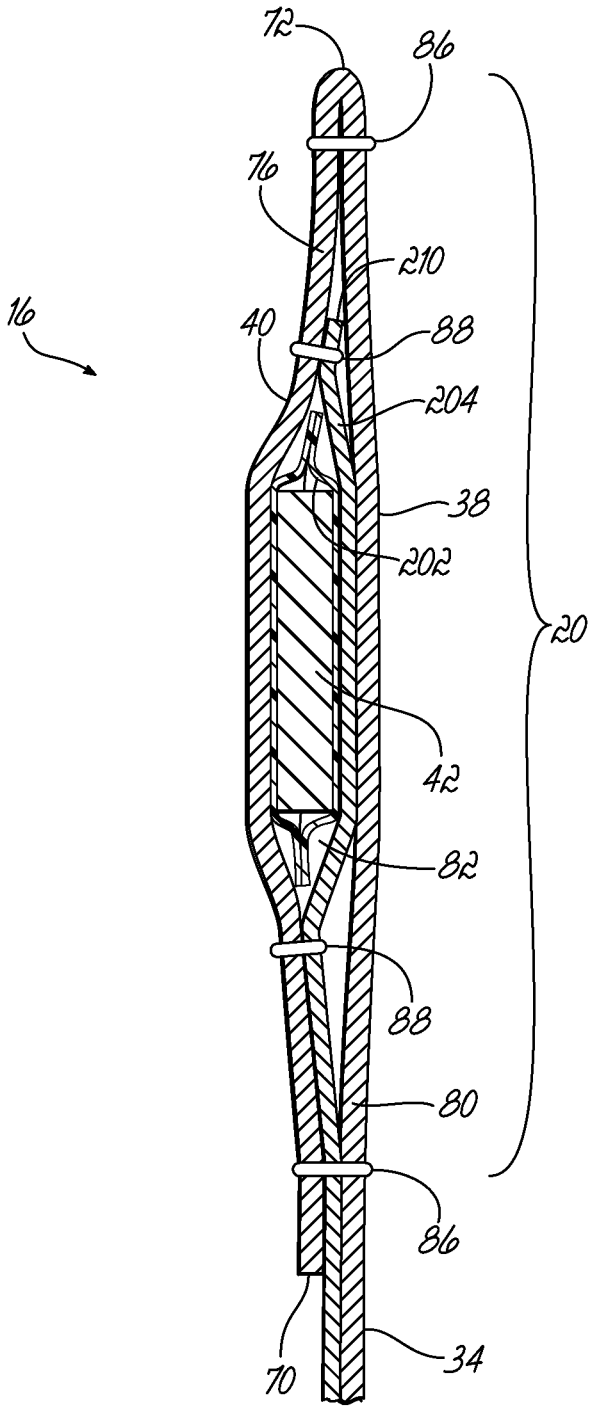
FIG. 16 is a cross-sectional view taken along line 16-16 of FIG. 15.
Figure 17:
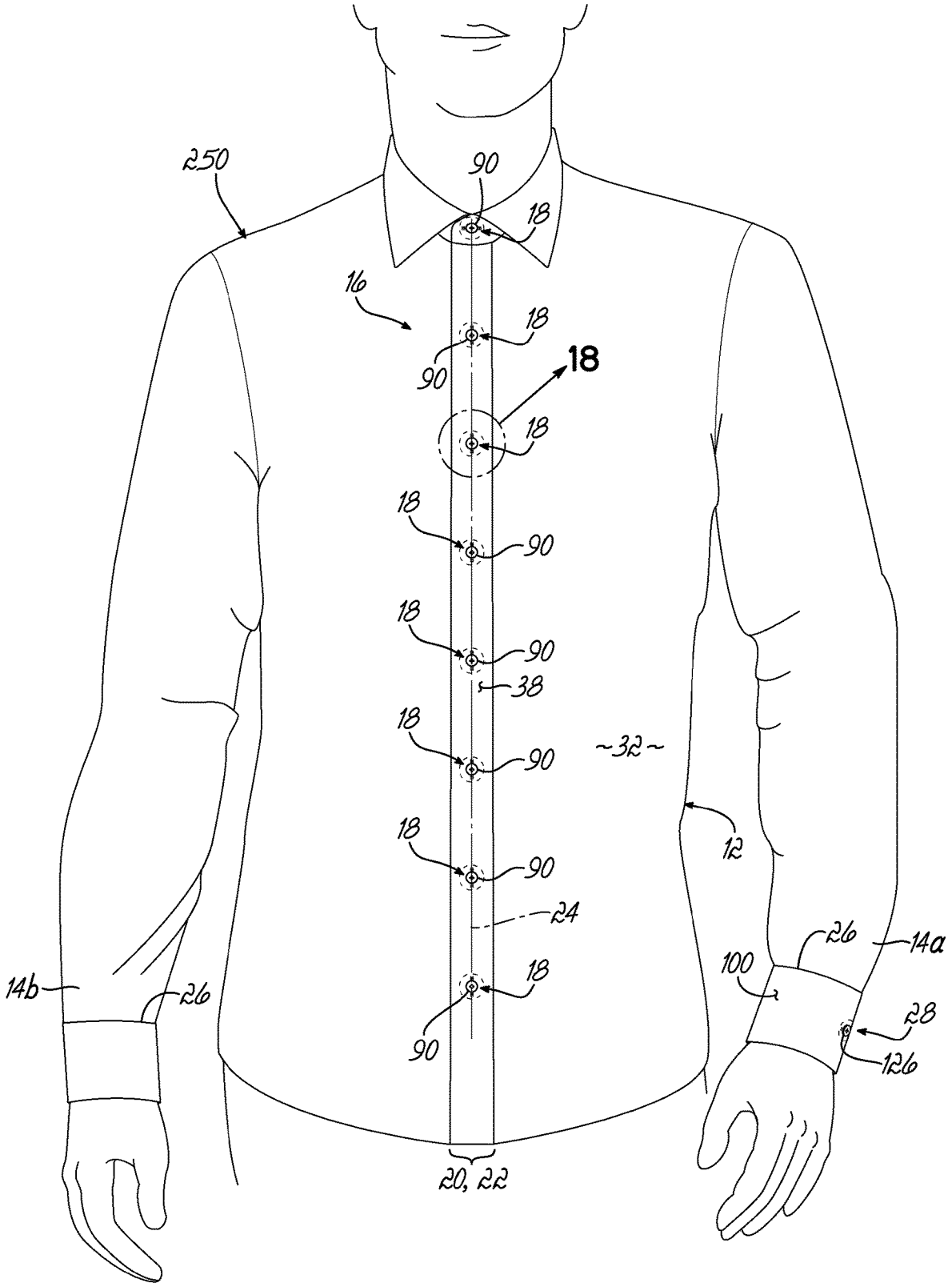
FIG. 17 is a front view of an article of clothing, such as a men's dress shirt according to aspects of the present invention.
Figure 17A:
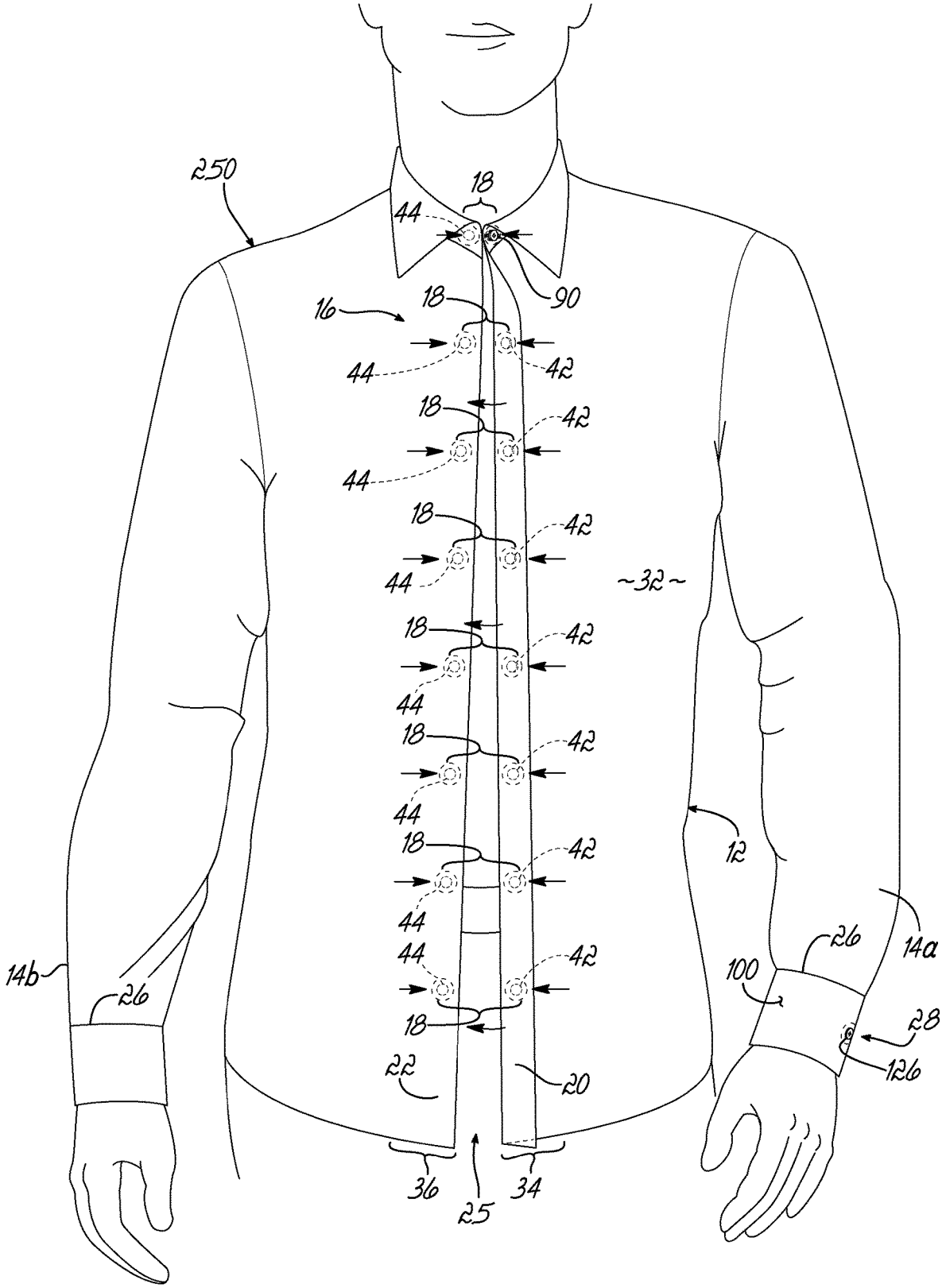
FIG. 17A is a front view of the men's dress shirt of FIG. 17 in which a plurality of magnetic fastening assemblies along a midline of the shirt are disengaged.
Figure 18:
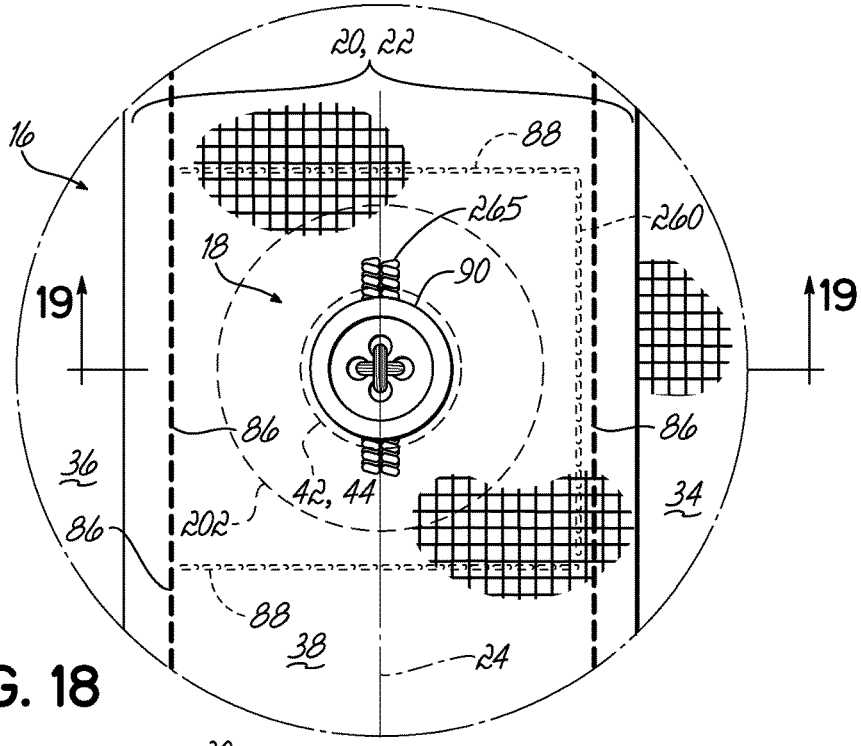
FIG. 18 is a magnified view of a portion of one of the magnetic fastening assemblies at encircled area 18 of FIG. 17.

With specific reference to FIGS. 12 and 13, each magnetic assembly 18 includes a plastic encasement 202 encasing or holding one of the magnetic elements 42, 44 therein. The encasement 202 is preferably made of polyvinylchloride but may be made of any other plastic material. The encasement 202 may be formed of two thin sheets of plastic that are fused, adhered, or otherwise coupled together around at least a portion of the periphery of one of the magnetic element 42, 44, so as to hold the magnetic element 42, 44 therein. The plastic encasement 202 may be circular, rectangular, or have any other suitable shape. The plastic encasement 202 functions to protect the magnet inside the plastic encasement. The plastic encasement 202 enables the coat or vest to be machine washable without corroding the magnet inside the plastic encasement 202. The plastic encasement 202 further enables the coat or vest to be dried in a household or commercial dryer without damaging the magnets.

Similar to the embodiment with the men's shirt 10 described above, the coat 200 has two plackets 20, 22. One magnetic element 42 of the magnetic fastening assembly 18 is associated with the left placket 20, and the other magnetic element 44 is associated with the right placket 22. With specific reference now to the embodiment shown in FIG. 13, the right placket 22 is formed from the sheet of material 32 that forms the main body portion 12 of the coat 200, as well as an inner sheet of material 204 that is coupled to an underside of the sheet of material 32 (i.e., forming an inside layer or a liner for the coat 200). An end portion 36 of the sheet of material 32 is folded at point 52 toward the interior and distal from the midline 24 so as to form a placket 22 with two layers 54, 56. A line of stitching 206 couples the two layers 54, 56 proximate the folded edge 52. An end 208 of the inner sheet of material 204 is positioned intermediate the layers 54, 56 and proximate the line of stitching 206. The layer 56 and the sheet of material 204 are coupled together so as to form a pocket 58 therebetween. In the embodiment shown, a line of stitching 60 couples the folded end portion 36 to the inner sheet of material 204 and the sheet of material 36 proximate an end 50 of the sheet of material 32. A person of ordinary skill will recognize that the right placket 22 may be formed in a variety of ways. For example, the line of stitching 206 may be excluded, such that the fold at point 52 defines one portion (i.e., one side) of the pocket 58.

A plurality of magnetic elements 44 of the magnetic assembly 18 may be positioned at predetermined locations in the pocket 58 between the layer 56 and the sheet of material 204 in the right placket 22. Each magnetic element 44 may be secured in the proper position by sewing together the layer 56 and the sheet of material 204 outside at least a portion of the perimeter of the magnetic element 44. As shown in FIG. 13, a resulting line of stitching 62 (shown in cross-section) may form a circle, rectangle, or other shape around the magnetic element 44 so as to restrict movement of the magnetic element 44 within the pocket 58. The line of stitching 62 indirectly couples the magnetic element 44 to the placket 22. In this way, it is unnecessary to sew through either of the magnetic element 44 or the plastic encasement 202. As such, both the magnetic element 44 and the plastic encasement 202 may be solid pieces without holes therethrough.

With further reference to the embodiment shown in FIG. 13, the left placket 20 is also formed from the same sheet of material 32 and in the same manner as the right placket 22. An end portion 34 of the sheet of material 32 is folded at point 72 toward the interior and distal from the midline 24 so as to form a placket 20 with two layers 76, 80. A line of stitching 86 couples the two layers 76, 80 proximate the point 72. An end 210 of the inner sheet of material 204 is positioned intermediate the layers 76, 80 and proximate the line of stitching 86. The layer 76 and the sheet of material 204 are coupled together so as to form a pocket 82 therebetween. In the embodiment shown, a line of stitching 86 couples the folded end portion 34 to the inner sheet of material 204 and the sheet of material 36 proximate an end 70 of the sheet of material 32. A person of ordinary skill will recognize that the right placket 20 may be formed in a variety of ways. For example, the line of stitching 86 may be excluded, such that the fold at point 72 defines one portion (i.e., one side) of the pocket 82. Moreover, it is not necessary that the left placket 20 be formed in an identical manner as the right placket 22.

The plurality of magnetic elements 42 of the magnetic assembly 18 may be positioned at predetermined locations in the pocket 82 between the layer 76 and the inner sheet of material 204 in the left placket 20. The locations of the magnetic elements 42 should correspond to the locations of the magnetic elements 44. The magnetic elements 42 may be secured in between the layer 76 and the inner sheet of material 204 of the left placket 20 in the same manner described above with respect to the right placket 22.

In the embodiment shown in FIGS. 11-16, the left placket 20 is designed to be positioned on top of the right placket 22 in the closed position. However, a person of ordinary skill will recognize that the configurations of the left and right plackets 20, 22 may be reversed, such that the right placket 22 is positioned on top of the left placket 20 in the closed position. Moreover, although the coat 200 shown in FIG. 11 does not include buttons 90 coupled to an exterior surface 38 of the left placket 22, such buttons 90 could be added, as described above with respect to the men's dress shirt 10.

With reference now to FIGS. 17-25, the fastening assembly 16 described above with respect to FIGS. 11-16 is used in a men's dress shirt 250 or a women's blouse 300 similar to the men's dress shirt 10 and the women's blouse 150, respectively, shown in FIGS. 1-9. The men's dress shirt 250 and the women's blouse 300 include many of the same features described above, which are referred to by the same reference numerals, unless indicated otherwise.

With specific reference to FIGS. 17-19A, similar to the men's dress shirt 10, the men's dress shirt 250 includes sheet of material 32 having end portions 34, 36 and respective plackets 20, 22. However, the plackets 20, 22 of the men's dress shirt 250 are formed differently than the plackets 20, 22 of the men's dress shirt 10. The right placket 22 is formed by folding the end portion 36 of the sheet of material 32 at point 52 toward the interior and distal from the midline 24 so as to form placket 22 with two layers 54, 56. The right edge 50 of the sheet of material 32 is further folded back toward the midline 24 such that the right edge 50 is positioned intermediate the layers 54, 56. The two layers 54, 56 are coupled together so as to form pocket 58 between the two layers 54, 56. Line of stitching 60 couples the folded end portion 36 to the sheet of material 32 proximate end 50 of the sheet of material 32.

Figure 18A:
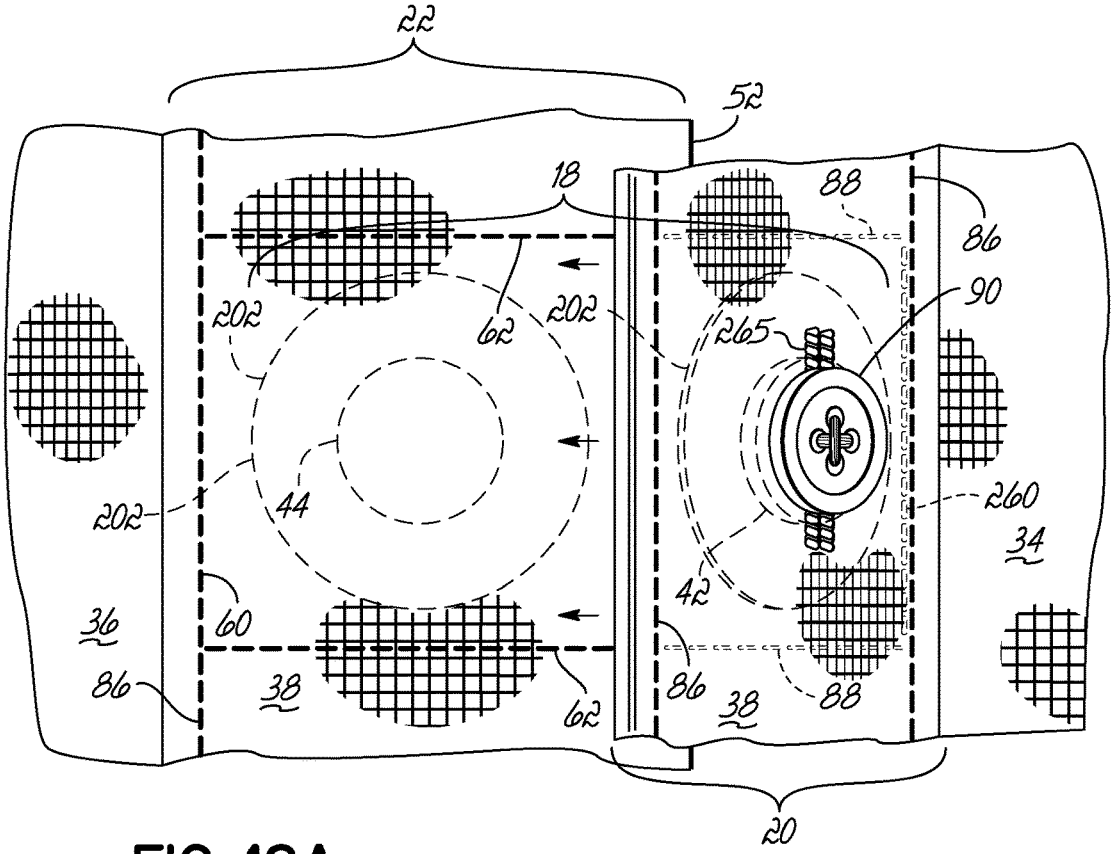
FIG. 18A is a magnified view of the portion of the magnetic fastening assembly of FIG. 18 in a disengaged configuration.
Figure 22:
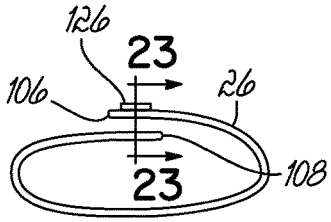
FIG. 22 is a schematic cross sectional view of a full cuff similar to that shown in FIG. 20.
Figure 23:
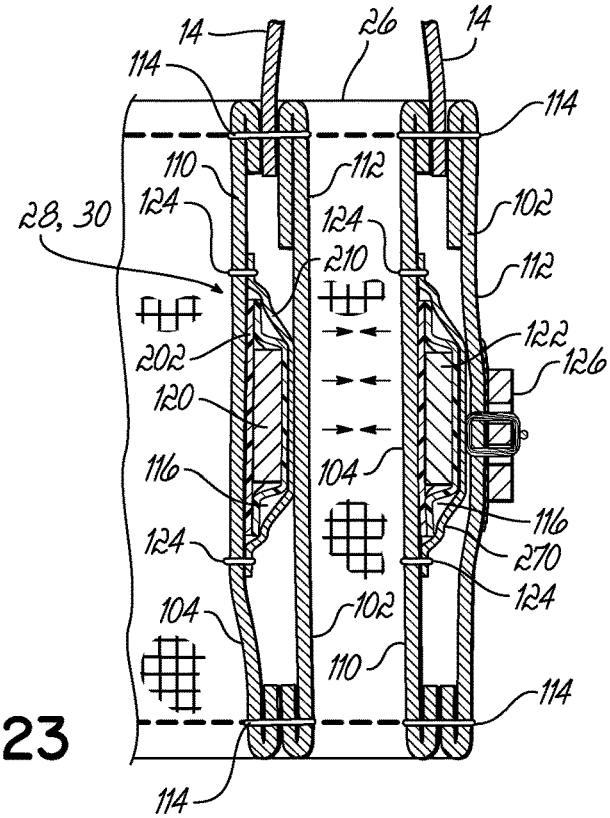
FIG. 23 is a cross sectional view taken along line 23-23 of the fastening assembly of FIG. 22.
Figure 20:
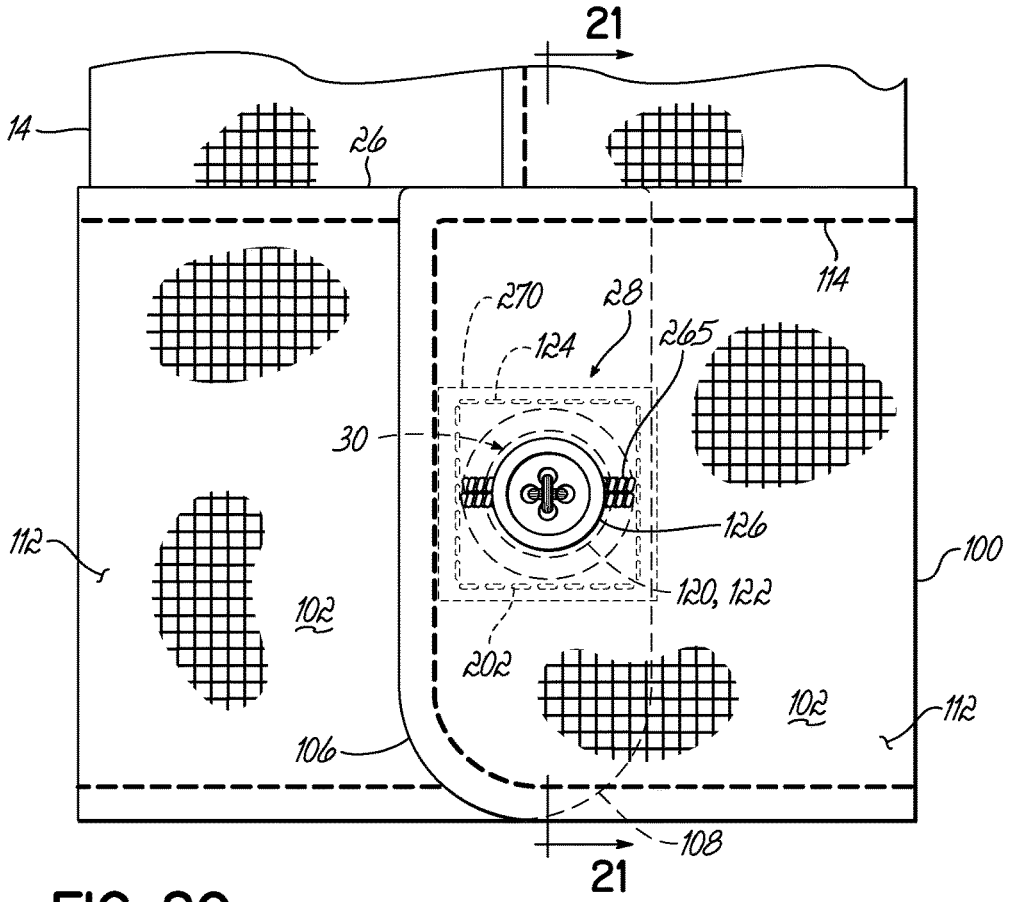
FIG. 20 is a front view of a cuff of an article of clothing, such as a dress shirt having a magnetic fastening assembly.
Figure 21:
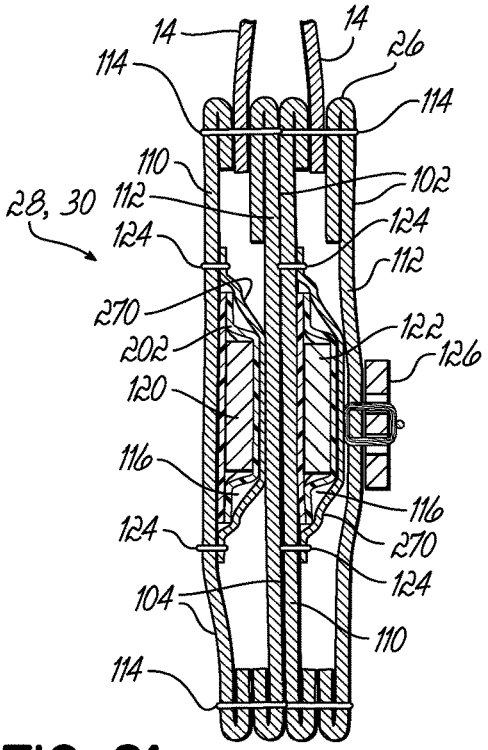
FIG. 21 is a cross-sectional view taken along line 21-21 of the fastening assembly of FIG. 20.

The plurality of magnetic elements 44 encased in plastic encasements 202 are positioned at predetermined locations in the pocket 58 between the two layers 54, 56 of material in the right placket 22, as described above, where each magnetic element 44 may be secured in the proper position by sewing together the two layers 54, 56 outside at least a portion of the perimeter of the plastic encasement 202. With specific reference to FIG. 18A, lines of stitching 62 may run between the fold at point 52 and the line of stitching 60 on both sides of the magnetic element 44. The magnet element 44 is encased in plastic encasement 202 so that the lines of stitching 62, the fold at point 52, and the line of stitching 60 together form a rectangular enclosure around the encased magnetic element 44. In this way, it is not necessary to sew through the magnetic element 44 or the plastic encasement 202 and, thus, both the magnetic element 44 and the plastic encasement 202 may be solid pieces without holes therethrough.

Figure 19:
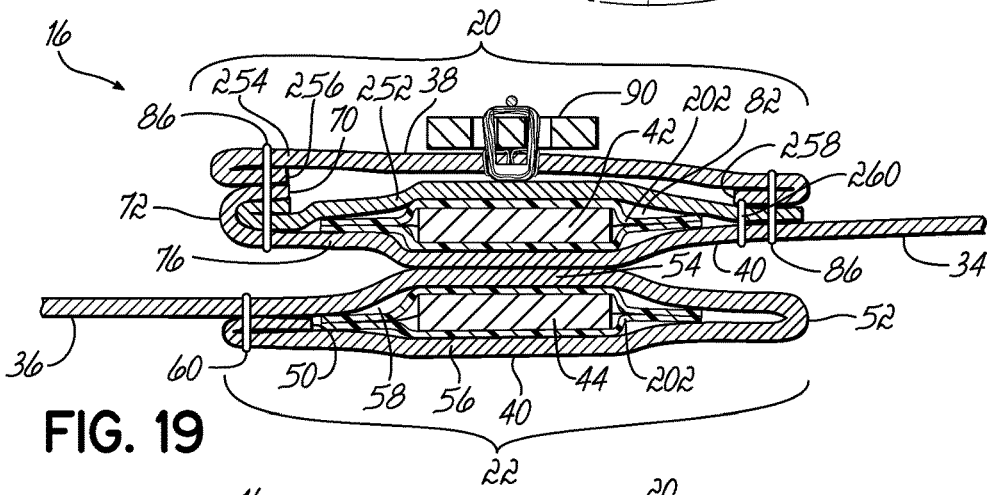
FIG. 19 is a cross-sectional view taken along line 19-19 of FIG. 18.
Figure 19A:
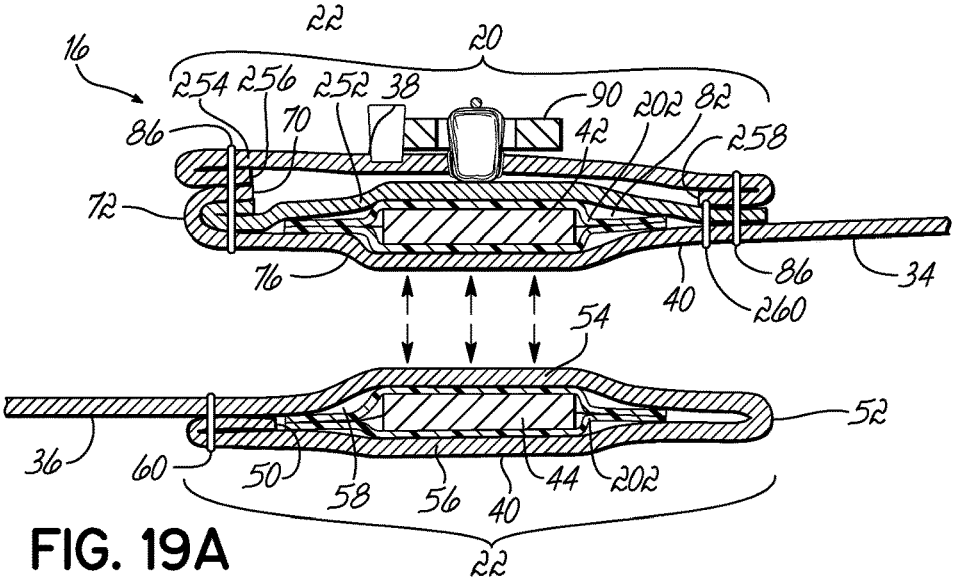
FIG. 19A is a cross-sectional view of the portion of the magnetic fastening assembly of FIG. 18A just prior to engagement.

With further reference to the embodiment shown in FIGS. 17-19A, the left placket 20 comprises a layer 76 formed from the left end portion 34 of the sheet of material 32 and a middle strip of material 252 and an outer strip of material 254 coupled to the layer 76. The outer strip of material 254 forms an exterior of the placket 20. The middle strip of material 252 is secured intermediate the layer 76 and the outer strip of material 254. The outer strip of material 254 may be reinforced or thicker than the sheet of material 32 and/or the middle strip of material 252. The left edge 70 of the sheet of material 32 is folded over the middle strip of material 252 at point 72, such that the left edge 70 is positioned intermediate the middle strip of material 252 and the outer strip of material 254. As shown in FIGS. 19 and 19*a*, edges 256, 258 of the outer strip of material 254 are also folded under toward an interior of the placket 20. Folding the edges 70, 256, 258 toward the interior of the placket 20 helps to reinforce the placket 20 and prevent fraying. A line of stitching 86 couples the layer 76 to the middle strip of material 252 and the outer strip of material 254 proximate the fold points 72, 256. Another layer of stitching 86 couples the layer 76 to the middle strip of material 252 and the outer strip of material 254 proximate the fold point 258. This coupling of the layer 76 to the middle strip of material 252 creates pocket 82 between the layer 76 and the middle strip of material 252. In addition, the layer 76 may be coupled to the middle strip of material 252 at a line of stitching 260 that runs generally parallel to the line of stitching 86 proximate edge 258 of the outer strip of material 254 (without sewing through the outer strip of material 254). In this way, during manufacturing, the line of the stitching 260 may help hold the encased magnetic element 42 in the pocket 82 (described in further detail below) before the outer strip of material 254 is coupled to the layer 76 and the middle strip of material 252.

Magnetic elements 42 encased in plastic encasements 202 are positioned at predetermined locations in the pocket 82 in the left placket 20, as described above, where each magnetic element 42 may be secured in the proper position by sewing together the layer 76 and the middle strip of material 252 outside at least a portion of the perimeter of the plastic encasement 202. With specific reference to FIGS. 18 and 18A, lines of stitching 88 may run between the line of stitching 86 adjacent point 72 and the line of stitching 260 on both sides of the magnetic element 42 encased in plastic encasement 202 so that the lines of stitching 86, 88, 260 together form a rectangular enclosure around the magnetic element 42. In this way, it is not necessary to sew through the magnetic element 42 or the plastic encasement 202 and, thus, both the magnetic element 42 and the plastic encasement 202 may be solid pieces without holes therethrough.

As described above with respect to the men's dress shirt 10, button 90 may be coupled to the exterior surface 38 of the outer strip of material 254. In addition, the exterior surface 38 of the outer strip of material 254 may have stitching thereon to create a "faux buttonhole" 265. The faux buttonhole 265 does not actually comprise a hole or slit in the outer strip of material 254, but rather, is provided for aesthetic purposes and to give the appearance that the buttons 90 are functional.

With reference to FIGS. 20-23, a similar fastening assembly as that described above with respect to the main body portion of the 12 of the men's dress shirt 250 may also be used on the cuffs 26. Similar to the cuff 26 described above with respect to the men's dress shirt 10, the cuff 26 comprises a band 100 including layers 110, 112 of material coupled together. The layer 112 may be reinforced or thicker than the layer 110. The cuff 26 further includes a middle piece of material 270 coupled to the layer 110 intermediate the layers 110, 112 at each of the end portions 106, 108 of the band 100. The middle piece of material 270 coupled to the layer 110 forms pocket 116.

The fastening assembly 28 for the cuff 26 may also include magnetic assembly 30 having magnetic elements 120, 122, each being encased in a plastic encasement 202. Encased magnetic element 120 may be coupled to end portion 106 of the band 100, and the other encased magnetic element 122 may be coupled to the other end portion 108 of the band 100. The encased magnetic elements 120, 122 may be positioned in the pockets 116 between the layer 110 and the middle pieces of material 270. At each pocket 116, the layer 110 and the middle piece of material 270 may be coupled together in line of stitching 124 around at least a portion of the perimeter of the encasement 202 of the magnetic element 122. The line of stitching 124 may be rectangular or circular, for example. In this way, it is not necessary to sew through the magnetic elements 120, 122 or the plastic encasements 202 and, thus, both the magnetic elements 120, 122 and the plastic encasements 202 may be solid pieces without holes therethrough.

Figure 24:
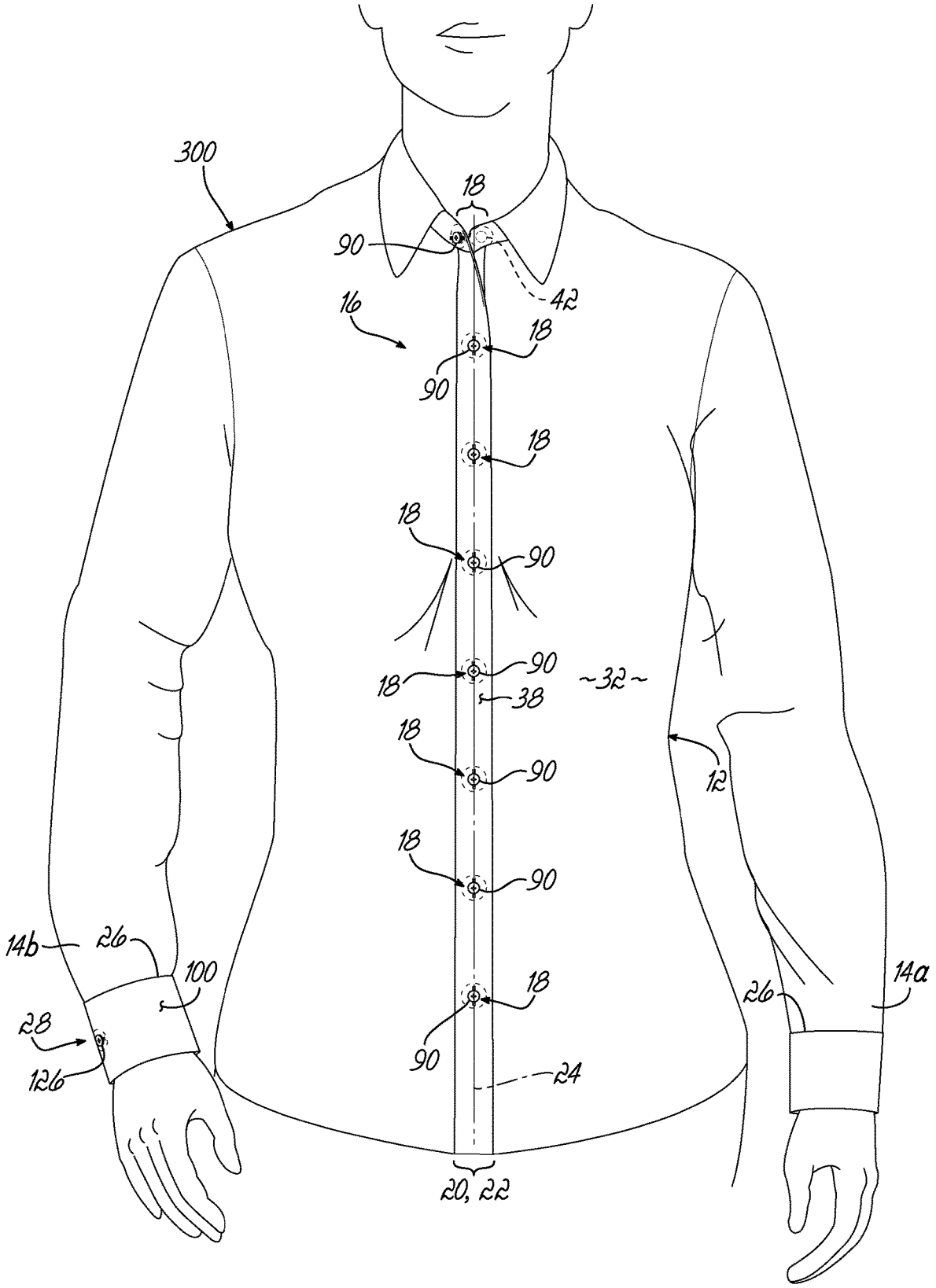
FIG. 24 is a front view of an article of clothing, such as a woman's blouse according to aspects of the present invention.
Figure 25:
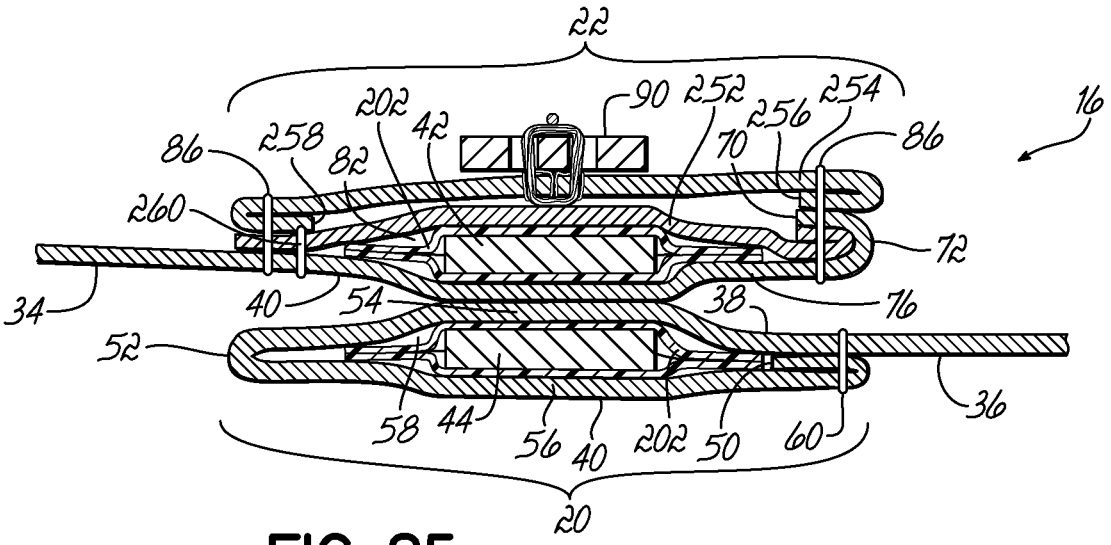
FIG. 25 is a cross-sectional view like FIG. 19 of the blouse of FIG. 24.

FIGS. 24 and 25 show fastening assembly 16 on an article of clothing shown as a women's blouse 300. The fastening assembly 16 on the women's blouse 300 has generally the same structure and generally functions in the same way as the fastening assembly 16 on the men's dress shirt 250. The main difference between the women's blouse 300 and the men's dress shirt 250 is that the right placket 22 is designed to be positioned on top of the left placket 20 in the engaged configuration for the women's blouse 300. In this way, the interior surface 40 of the right placket 22 faces and is positioned substantially adjacent the exterior surface 38 of the left placket 20. The women's blouse 300 is similar to the women's blouse 150, except that the plackets 20, 22 are formed like the plackets 20, 22 of the men's dress shirt 250, as described above, and the magnetic elements 40, 42 used in the women's blouse 300 are encased in plastic encasements 202.

The principles of the present invention, as well as any combination of the features described herein, may be used with dress shirts, blouses, coats, jackets, vests, medical gowns, or other articles of clothing. In particular, any embodiment of a magnetic fastening assembly 18 may include encasements 202 encasing at least one of the magnetic elements 42, 44 therein. The plastic encasement 202 functions to protect the magnet and enables the article of clothing to be machine washable without corroding the magnet inside the plastic encasement 202. The plastic encasement further enables the article of clothing to be dried in a household or commercial dryer without damaging the magnets. Moreover, any embodiment of the magnetic elements 42, 44, 120, 122 may be used with any embodiment of the plackets 20, 22 or the band 100 of the cuff 26.

Moreover, the article of clothing may be adjusted for children. For example, children's articles of clothing may have fewer magnetic assemblies 18 and/or less distance between the magnetic assemblies 18. The drawings are not intended to limit the present invention to clothing of any particular size. The drawings merely illustrate examples. The articles of clothing shown may be any desired sizes, including men's, women's, and children's sizes.

While I have described several preferred embodiments of the present invention, persons skilled in the art will appreciate changes and modifications which may be made without departing from the spirit of the invention. Therefore, I intend to be limited only by the scope of the following claims and equivalents thereof:

I claim:

1. An article of clothing comprising:

a sheet of material having a body portion having first and second end portions;

the first end portion of the sheet being folded twice and secured to itself with a line of stitching to create a first placket having two folds, the first placket comprising an inside layer of the first placket and an outside layer of the first placket coupled together to form a first pocket between the inside and outside layers of the first placket, a first edge of the sheet being between the inside and outside layers of the first placket and the outside layer of the first placket being a first extension of the body portion of the sheet;

a second placket comprising an inside layer, a middle strip of material and an outer strip of material, the inside layer of the second placket being a second extension of the body portion of the sheet, the inside layer of the second placket being folded over the middle strip of material, outer edges of the outer strip of material being folded towards an interior of the second placket to prevent fraying, the inside layer of the second placket, the middle strip of material and the outer strip of material being secured together by a first line of stitching of the second placket, the inside layer of the second placket and the middle strip of material being secured together by a second line of stitching of the second placket, the inside layer of the second placket and the middle strip of material and one of the folded ends of the outer strip of material being secured together by a third line of stitching of the second placket, the first, second and third lines of stitching of the second placket being parallel and the second line of stitching of the second placket being between the first and third lines of stitching of the second placket, a second pocket being located between the inside layer of the second placket and the middle strip of material between the first and second lines of stitching of the second placket; and a plurality of encased first magnetic elements secured inside the first pocket and a plurality of encased second magnetic elements secured inside the second pocket, first stitches joining the inside and outside layers of the first placket outside at least a portion of a perimeter of each encased first magnetic element for restraining movement of each encased first magnetic element in the first pocket and second stitches joining only the inside layer and the middle strip of material of the second placket outside at least a portion of a perimeter of each encased second magnetic element for restraining movement of each encased second magnetic element in the second pocket;

at least some of the encased first magnetic elements being adapted to engage with at least some of the encased second magnetic elements to close the article of clothing around a person's body, positions of the plurality of encased second magnetic elements in the second pocket corresponding to positions of the plurality of encased first magnetic elements in the first pocket, the second placket overlaying the first placket such that the first and second stitches securing the pluralities of encased first and second magnetic elements in place are not visible from an exterior of the article of clothing when the article of clothing is closed.

2. The article of clothing of claim 1, further comprising a plurality of buttons coupled to only the outer strip of material of the second placket to provide an appearance that the article of clothing has no magnets.

3. The article of clothing of claim 1, wherein the first and second stitches form rectangular enclosures.

4. The article of clothing of claim 1, wherein the first and second stitches form circular enclosures.

5. The article of clothing of claim 1, wherein each of the encased first and second magnetic elements is rectangular.

6. The article of clothing of claim 1, wherein the first placket is on a right side of the article of clothing.

7. The article of clothing of claim 1, wherein the first placket is on a left side of the article of clothing.

8. The article of clothing of claim 1, wherein each of the encased first and second magnetic elements includes a solid magnetic element.

9. The article of clothing of claim 1, wherein each of the encased first and second magnetic elements comprises a plastic encasement encasing a magnetic element.

10. The article of clothing of claim 1, further comprising:

a pair of sleeves;

a cuff located at a distal end of each sleeve; and an encased magnetic fastening assembly coupled to each cuff.

11. An article of clothing comprising:

a sheet of material having a body portion with opposed first and second end portions, the first end portion of the sheet being folded twice and secured to itself with a line of stitching proximate a first edge of the sheet, to create a first placket having first and second folds, the first placket comprising an inside layer of the first placket and an outside layer of the first placket coupled together to form a first pocket between the inside and outside layers of the first placket and between the first fold and the line of stitching, the line of stitching extending through the second fold;

a second placket comprising an inside layer, a middle strip of material and an outer strip of material, the inside layer of the second placket being a second extension of the body portion of the sheet, the inside layer of the second placket being folded once, edges of the outer strip of material being folded towards an interior of the second placket to prevent fraying, the inside layer of the second placket, the middle strip of material and the outer strip of material being secured together by a first line of stitching of the second placket, the inside layer of the second placket and the middle strip of material being secured together by a second line of stitching of the second placket, the inside layer of the second placket and the middle strip of material and the outer strip of material being secured together by a third line of stitching of the second placket, the second line of stitching of the second placket being between the first and third lines of stitching of the second placket;

a second pocket being located between the inside layer of the second placket and the middle strip of material between the first and second lines of stitching of the second placket; and a plurality of encased first magnetic elements secured inside the first pocket and a plurality of encased second magnetic elements secured inside the second pocket, each of the encased first magnetic elements being secured in position in the first pocket by stitches joining the inside and outside layers of the first placket around each encased first magnetic element for restraining movement of each encased first magnetic element, and each encased second magnetic element being secured in position in the second pocket by additional stitches joining only the inside layer of the second placket and the middle strip of material around each encased second magnetic element for restraining movement of each encased second magnetic element, at least some of the encased first magnetic elements adapted to be engaged to be attracted to at least some of the encased second magnetic elements to close the article of clothing around a person's body, positions of the plurality of encased second magnetic elements corresponding to positions of the plurality of encased first magnetic elements wherein when the article of clothing is closed, the stitches and additional stitches around each of the first and second encased magnetic elements not being visible from an exterior of the article of clothing.

12. The article of clothing of claim 11, further comprising a plurality of buttons coupled to the outer strip of material of the second placket.

13. The article of clothing of claim 11, wherein the first placket is on a right side of the article of clothing.

14. The article of clothing of claim 11, wherein the stitches around each of the encased first magnetic elements creates a rectangular enclosure.

15. The article of clothing of claim 11, wherein the additional stitches around each of the encased second magnetic elements creates a rectangular enclosure.

16. The article of clothing of claim 11, further comprising:

a pair of sleeves;

a cuff located at a distal end of each sleeve; and an encased magnetic fastening assembly coupled to each cuff.

17. An article of clothing comprising:

a sheet of material forming a body portion, the sheet of material having first and second end portions, a first placket integrally formed on the first end portion of the sheet of material and comprising the first end portion of the sheet having first and second folds, the first end portion of the sheet of material being secured to itself by a line of stitching extending through the second fold, the first placket comprising an inside layer of the first placket and an outside layer of the first placket coupled together to form a first pocket between the inside and outside layers of the first placket and between the first fold and line of stitching, a second placket comprising an inside layer, a middle strip of material and an outer strip of material, the inside layer of the second placket being an extension of the second end portion of the sheet of material folded once, the outer strip of material having opposed folded end portions to prevent fraying, the inside layer of the second placket, the middle strip of material and the outer strip of material being secured together by a first line of stitching of the second placket, the inside layer of the second placket and the middle strip of material being secured together by a second line of stitching of the second placket, the inside layer of the second placket and the middle strip of material and one of the opposed folded end portions of the outer strip of material being secured together by a third line of stitching of the second placket, the second line of stitching of the second placket being between the first and third lines of stitching of the second placket;

a second pocket being located between the inside layer of the second placket and the middle strip of material between the first and second lines of stitching of the second placket; and a plurality of encased first magnetic elements secured inside the first pocket and a plurality of encased second magnetic elements secured inside the second pocket, each encased first magnetic element being secured in position by stitches joining the inside and outside layers of the first placket around each encased first magnetic element for restraining movement of each encased first magnetic element, and each encased second magnetic element being secured in position in the second pocket by additional stitches joining only the inside layer of the second placket and the middle strip of material around each encased second magnetic element for restraining movement of each encased second magnetic element, at least some of the encased first magnetic elements adapted to be engaged to be attracted to at least some of the encased second magnetic elements to close the article of clothing around a person's body, positions of the plurality of encased second magnetic elements corresponding to positions of the plurality of encased first magnetic elements wherein when the article of clothing is closed, the stitches and additional stitches around the plurality of encased first and second encased magnetic elements, respectively, not being visible from an exterior of the article of clothing.

18. The article of clothing of claim 17, further comprising buttons coupled to only the outside layer of the outer strip of material of the second placket to provide appearance that the article of clothing has no magnets.

19. The article of clothing of claim 17, wherein the stitches outside each of the encased first magnetic elements form a rectangular enclosure and the additional stitches outside each of the encased second magnetic elements forms a rectangular enclosure.

20. The article of clothing of claim 17, further comprising:

a pair of sleeves;

a cuff located at a distal end of each sleeve; and an encased magnetic fastening assembly coupled to each cuff.

* * * * *